US010870285B2

(12) United States Patent
Ishibe

(10) Patent No.: US 10,870,285 B2
(45) Date of Patent: Dec. 22, 2020

(54) LIQUID EJECTION DEVICE INCLUDING TANK AND CARTRIDGE CONNECTABLE THERETO

(71) Applicant: BROTHER KOGYO KABUSHIKI KAISHA, Nagoya (JP)

(72) Inventor: Akinari Ishibe, Okazaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/225,819

(22) Filed: Dec. 19, 2018

(65) Prior Publication Data

US 2019/0193406 A1 Jun. 27, 2019

(30) Foreign Application Priority Data

Dec. 27, 2017 (JP) ..... 2017-250655
Dec. 27, 2017 (JP) ..... 2017-251228

(51) Int. Cl.
*B41J 2/175* (2006.01)
*B41J 29/13* (2006.01)

(52) U.S. Cl.
CPC ..... *B41J 2/1752* (2013.01); *B41J 2/17513* (2013.01); *B41J 2/17523* (2013.01); *B41J 2/17553* (2013.01); *B41J 29/13* (2013.01); *B41J 2002/17573* (2013.01)

(58) Field of Classification Search
CPC ..... B41J 2/1752; B41J 29/13; B41J 2/17513; B41J 2/17553; B41J 2/17523; B41J 2002/17573; B41J 2/17509
See application file for complete search history.

(56) References Cited

U.S. PATENT DOCUMENTS

2005/0134661 A1* 6/2005 Miyazawa ..... B41J 2/17503 347/86
2009/0201351 A1 8/2009 Shimizu et al.
2018/0244059 A1* 8/2018 Hayashi ..... B41J 2/17513
2018/0244060 A1* 8/2018 Hayashi ..... B41J 29/13
2019/0291446 A1* 9/2019 Hayashi ..... B41J 2/17513
2019/0381800 A1* 12/2019 Takahashi ..... B41J 2/17523

FOREIGN PATENT DOCUMENTS

JP 2007-83548 A 4/2007
JP 2008-238792 A 10/2008

* cited by examiner

*Primary Examiner* — Justin Seo
(74) *Attorney, Agent, or Firm* — Merchant & Gould P.C.

(57) ABSTRACT

The liquid ejection device includes a cartridge, a cartridge receiving portion and a head. The cartridge includes a first storage chamber, a first air communication port, and a supply portion. The cartridge receiving portion includes a joint, a second storage chamber, a second air communication port, and an outlet port. Liquid is supplied from the first storage chamber to the second storage chamber through the supply portion connected to the joint by water head difference. The second storage chamber includes: an upper region connected to the joint; and a lower region positioned below the upper region. The lower region has a portion positioned below a lowermost surface of the cartridge and extending along the lowermost surface when the supply portion is connected to the joint. The portion of the lower region extends away from the upper region to protrude further relative to the upper region in a protruding direction.

21 Claims, 14 Drawing Sheets

LIQUID EJECTION DEVICE INCLUDING TANK AND CARTRIDGE CONNECTABLE THERETO

CROSS REFERENCE TO RELATED APPLICATION

This application claims priorities from Japanese Patent Application Nos. 2017-250655 filed Dec. 27, 2017 and 2017-251228 filed Dec. 27, 2017. The entire contents of the priority applications are incorporated herein by reference.

TECHNICAL FIELD

The present disclosure relates to a liquid ejection device configured to eject liquid stored in a cartridge and a cartridge receiving portion.

BACKGROUND

Japanese Patent Application Publication No. 2008-238792 discloses an inkjet recording device that includes a cartridge storing an ink, a cartridge receiving portion to which the cartridge is attached and from which the cartridge is detached, a sub-tank storing the ink supplied, by water head difference, from the cartridge attached to the cartridge receiving portion, and a recording portion configured to eject ink stored in the sub-tank onto an image-recording medium to form an image thereon.

SUMMARY

The above-identified inkjet recording device can continue to perform image recording operations by ejecting ink stored in the sub-tank for a certain period of time until the cartridge is replaced with a new cartridge after ink in the cartridge can no longer be supplied to the sub-tank (hereinafter, simply referred to as "cartridge empty").

A volume of the sub-tank may be enlarged to prolong the time duration during which the recording device can continue to perform image recording operations. However, such enlargement in volume of the sub-tank will necessitate an enlarged space for the layout of the cartridge and the cartridge receiving portion.

Further, a user cannot visually recognize that the image recording operations can still be performed despite the fact that ink cannot be supplied from the cartridge to the sub-tank any longer.

In view of the foregoing, it is an object of the disclosure to provide a liquid ejection device capable of ejecting liquid from a head even after liquid can no longer be supplied to a sub-tank from a cartridge, with an excellent space efficiency.

It is another object of the disclosure to provide a liquid ejection device that enables a user to visually recognize that liquid can still be ejected from the head even after liquid to be supplied to the sub-tank is no longer available in the cartridge.

In order to attain the above and other objects, according to one aspect, the disclosure provides a liquid ejection device including a cartridge, a cartridge receiving portion, and a head. The cartridge includes: a first storage chamber configured to store therein a liquid; a first air communication port allowing the first storage chamber to communicate with an atmosphere; and a supply portion configured to supply the liquid stored in the first storage chamber. The cartridge receiving portion includes: a joint to which the supply portion is connectable; a second storage chamber configured to store therein the liquid supplied, by water head difference, from the first storage chamber through the supply portion connected to the joint; an outlet port positioned below the joint, the liquid stored in the second storage chamber is configured to be discharged through the outlet port; and a second air communication port allowing the second storage chamber to communicate with the atmosphere. The head is configured to eject the liquid flowing thereinto from the second storage chamber through the outlet port. The second storage chamber has an upper region and a lower region positioned below the upper region defined in an operational posture of the liquid ejection device. The joint is connected to the upper region. The lower region has a portion positioned below a lowermost surface of the cartridge in a vertical direction and extending along the lowermost surface of the cartridge in a state where the supply portion of the cartridge is connected to the joint in the operational posture of the liquid ejection device. The portion of the lower region extends away from the upper region to protrude further in a protruding direction crossing the vertical direction relative to the upper region.

BRIEF DESCRIPTION OF THE DRAWINGS

The particular features and advantages of the embodiments as well as other objects will become apparent from the following description taken in connection with the accompanying drawings, in which.

DETAILED DESCRIPTION

1. First Embodiment

A multifunction peripheral 10 as an example of a liquid ejection device according to a first embodiment will be described with reference to FIGS. 1 through 8.

Figure 1A:
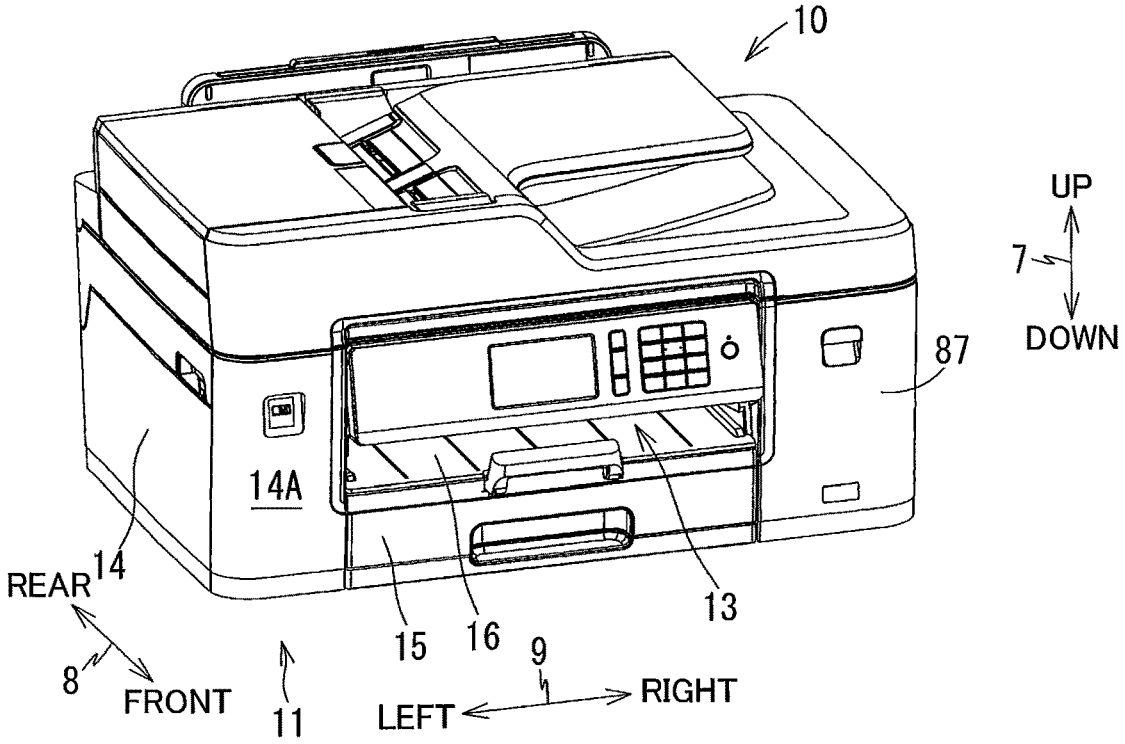
FIG. 1A is a perspective view of a multifunction peripheral according to a first embodiment of the present disclosure, in which a cover of the multifunction peripheral is at a closed position.

In the following description, up, down, front, rear, left, and right directions related to the multifunction peripheral 10 will be referred to assuming that the multifunction peripheral 10 is disposed on a horizontal plane so as to be operable, as shown in FIG. 1A. Note that this posture of the multifunction peripheral 10 illustrated in FIG. 1A will also be referred to as an "operable posture". Specifically, an up-down direction 7 of the multifunction peripheral 10 will be defined based on the operable posture of the multifunction peripheral 10. A front-rear direction 8 will be defined assuming that a surface of the multifunction peripheral 10 formed with an opening 13 is a front surface of the multifunction peripheral 10 in the operable posture. A left-right direction 9 will be defined based on an assumption that the multifunction peripheral 10 in the operable posture is viewed from its front side. In the present embodiment, in the operable posture of the multifunction peripheral 10, the up-down direction 7 is parallel to a vertical direction, and the front-rear direction 8 and the left-right direction 9 are parallel to a horizontal direction. Further, the front-rear direction 8 is perpendicular to the left-right direction 9.

Overall Structure of Multifunction Peripheral 10

Figure 1B:
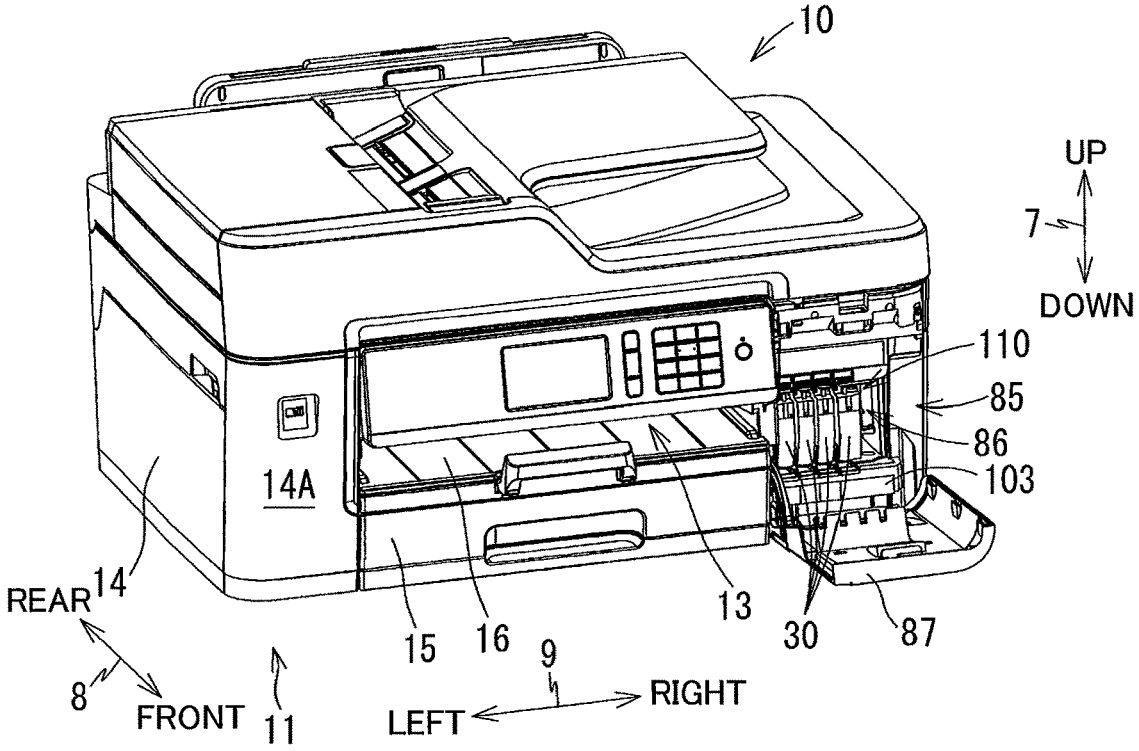
FIG. 1B is a perspective view of the multifunction peripheral according to the first embodiment, in which the cover is at an open position.

As illustrated in FIGS. 1A and 1B, the multifunction peripheral 10 has a substantially rectangular parallelepiped shape. The multifunction peripheral 10 has a lower portion at which a printer portion 11 is provided. The printer portion 11 is configured to record an image on a sheet of paper 12 (see FIG. 2) based on an inkjet recording method. The multifunction peripheral 10 may also have a facsimile function, a scanning function, and a copying function.

Figure 2:
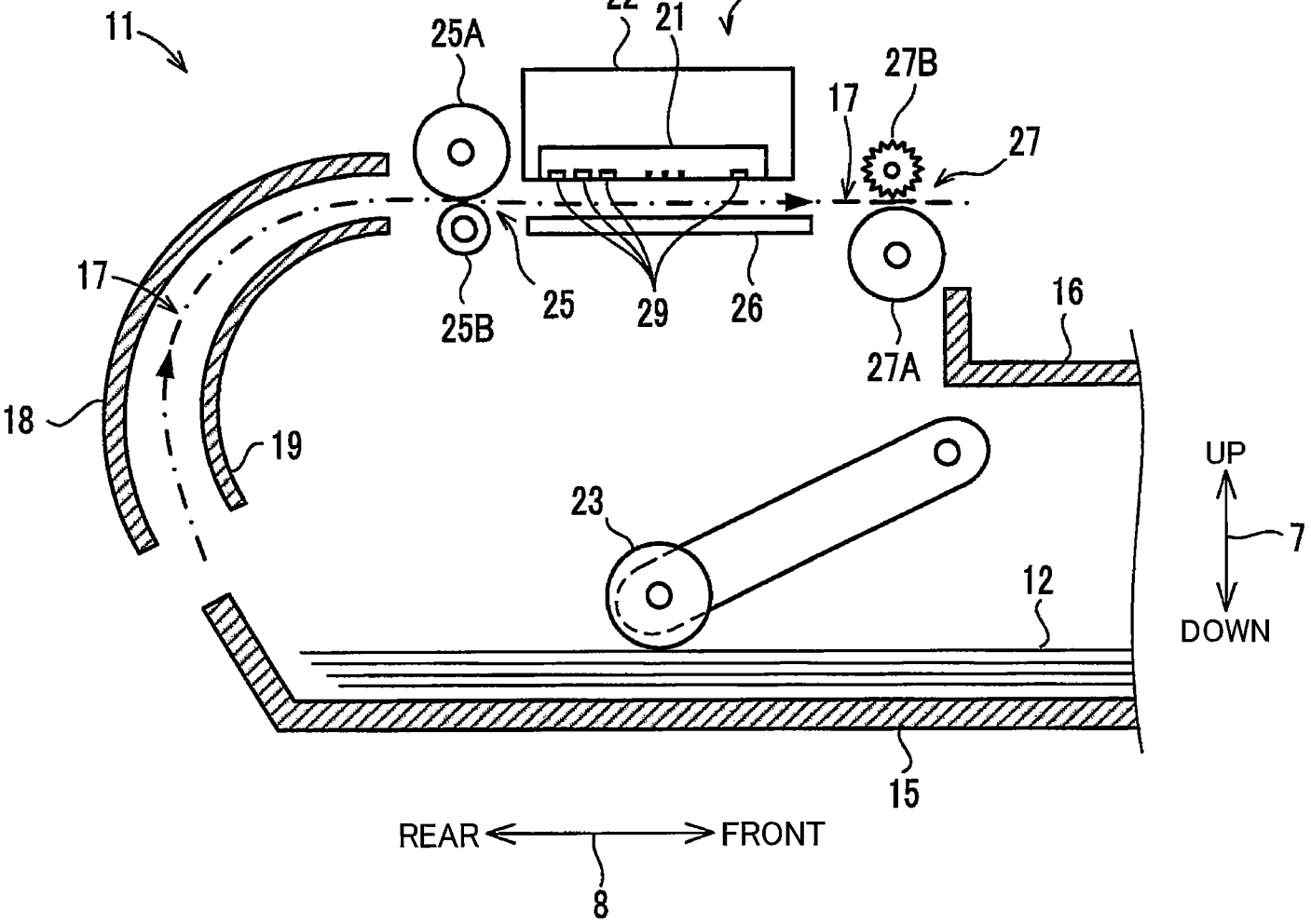
FIG. 2 is a vertical cross-sectional view schematically illustrating an internal structure of a printer portion 11 of the multifunction peripheral according to the first embodiment.

The printer portion 11 includes a casing 14 having a generally rectangular parallelepiped shape. As illustrated in FIG. 2, within the casing 14 provided are a feed tray 15, a discharge tray 16, a feed roller 23, a conveying roller pair 25, a recording portion 24, a discharge roller pair 27, and a platen 26.

Feed Tray 15, Discharge Tray 16, Feed Roller 23

As illustrated in FIGS. 1A, 1B and 2, the casing 14 has a front surface 14A at which the opening 13 is formed. The opening 13 is positioned at a generally center portion of the front surface 14A of the casing 14 in the left-right direction 9. The feed tray 15 is configured to be inserted into and removed from the casing 14 through the opening 13 in the front-rear direction 8 by a user. As illustrated in FIG. 2, the feed tray 15 is configured to support a plurality of sheets 12 in a stacked state. The discharge tray 16 is positioned above the feed tray 15. The discharge tray 16 is configured to support the sheets 12 passing through a portion between the recording portion 24 and the platen 26 and discharged by the discharge roller pair 27. The feed roller 23 is configured to feed each of the sheets 12 supported on the feed tray 15 toward a conveying path 17. The feed roller 23 is configured to be driven by a feed motor (not illustrated).

Conveying Path 17

As illustrated in FIG. 2, the conveying path 17 is a space defined mainly by guide members 18, 19, the recording portion 24 and the platen 26. Inside the printer portion 11, the guide members 18 and 19 face each other with a predetermined interval, and the recording portion 24 and the platen 26 face each other with a predetermined gap therebetween. The conveying path 17 extends upward from a rear end portion of the feed tray 15, while making a U-turn toward the front, and passes through a space between the recording portion 24 and the platen 26, and reaches the discharge tray 16. A conveying direction of the sheet 12 in the conveying path 17 is indicated by a dashed-dotted arrow in FIG. 2.

Conveying Roller Pair 25

As illustrated in FIG. 2, the conveying roller pair 25 is disposed at the conveying path 17 and upstream relative to the recording portion 24 in the conveying direction. The conveying roller pair 25 includes a conveying roller 25A and a pinch roller 25B opposed to each other. The conveying roller 25A is configured to be driven by a conveying motor (not illustrated). The pinch roller 25B is configured to be rotated in accordance with rotation of the conveying roller 25A. When the conveying roller 25A is rotated forward in response to forward rotation of the conveying motor, the sheet 12 is conveyed in the conveying direction (i.e. frontward direction) while nipped between the conveying roller 25A and the pinch roller 25B.

Discharge Roller Pair 27

As illustrated in FIG. 2, the discharge roller pair 27 is disposed at the conveying path 17 at a position downstream of the recording portion 24 in the conveying direction. The discharge roller pair 27 includes a discharge roller 27A and a spur roller 27B opposed to each other. The discharge roller 27A is configured to be driven by the conveying motor (not illustrated). The spur roller 27B is configured to be rotated in accordance with rotation of the discharge roller 27A. When the discharge roller 27A is rotated forward in response to the forward rotation of the conveying motor, the sheet 12 is conveyed in the conveying direction (i.e. frontward direction) while nipped between the discharge roller 27A and the spur roller 27B.

Recording Portion 24 and Platen 26

As illustrated in FIG. 2, the recording portion 24 and the platen 26 are positioned at the conveying path 17 at a position between the conveying roller pair 25 and the discharge roller pair 27. Specifically, the recording portion 24 and the platen 26 are positioned downstream of the conveying roller pair 25 and upstream of the discharge roller pair 27 in the conveying direction. The recording portion 24 is arranged to oppose the platen 26 in the up-down direction 7, with the conveying path 17 interposed between the recording portion 24 and the platen 26.

Figure 3:
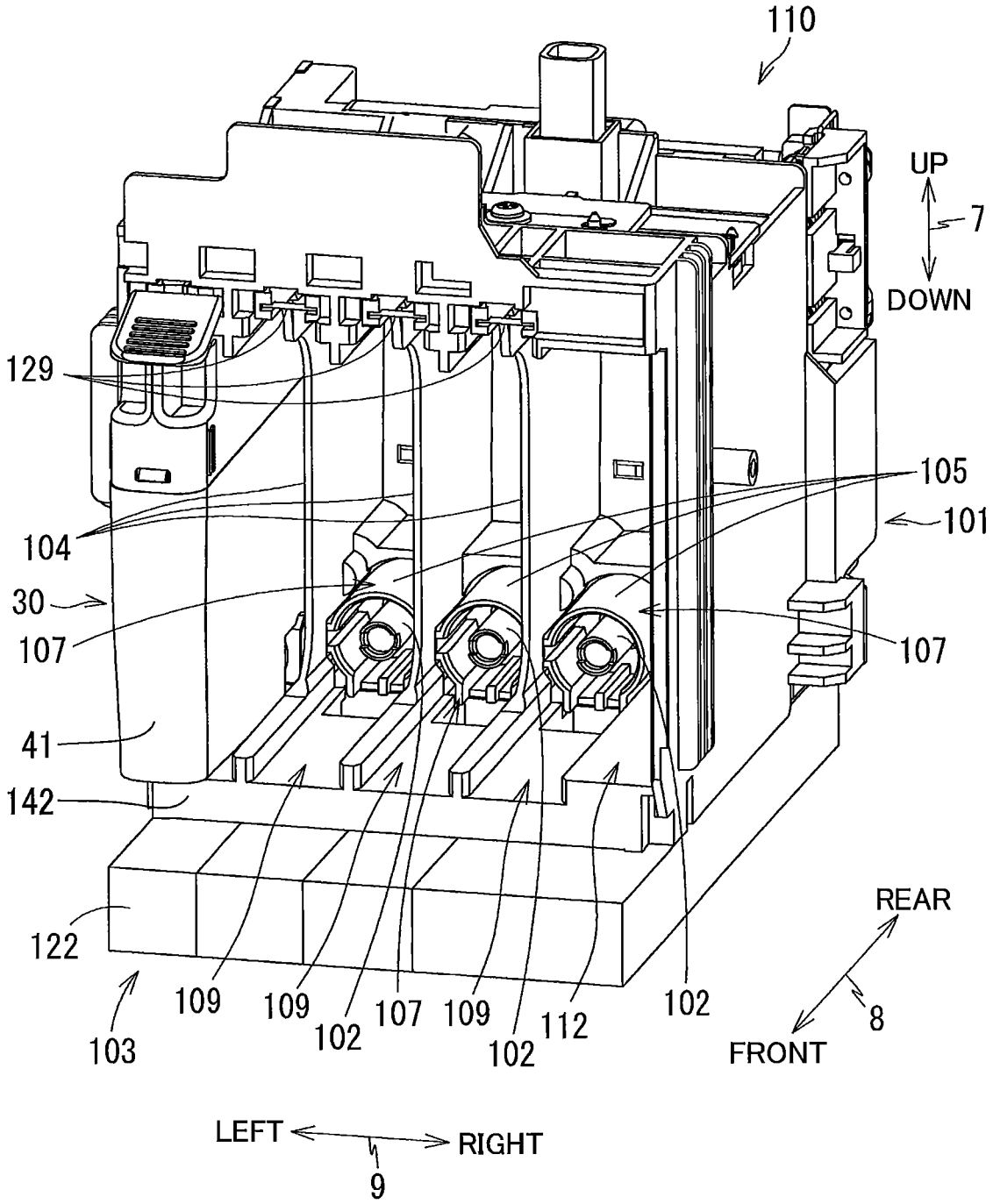
FIG. 3 is a perspective view of a cartridge receiving portion in the multifunction peripheral according to the first embodiment as viewed from a side of the cartridge receiving portion at which an opening is formed.
Figure 4:
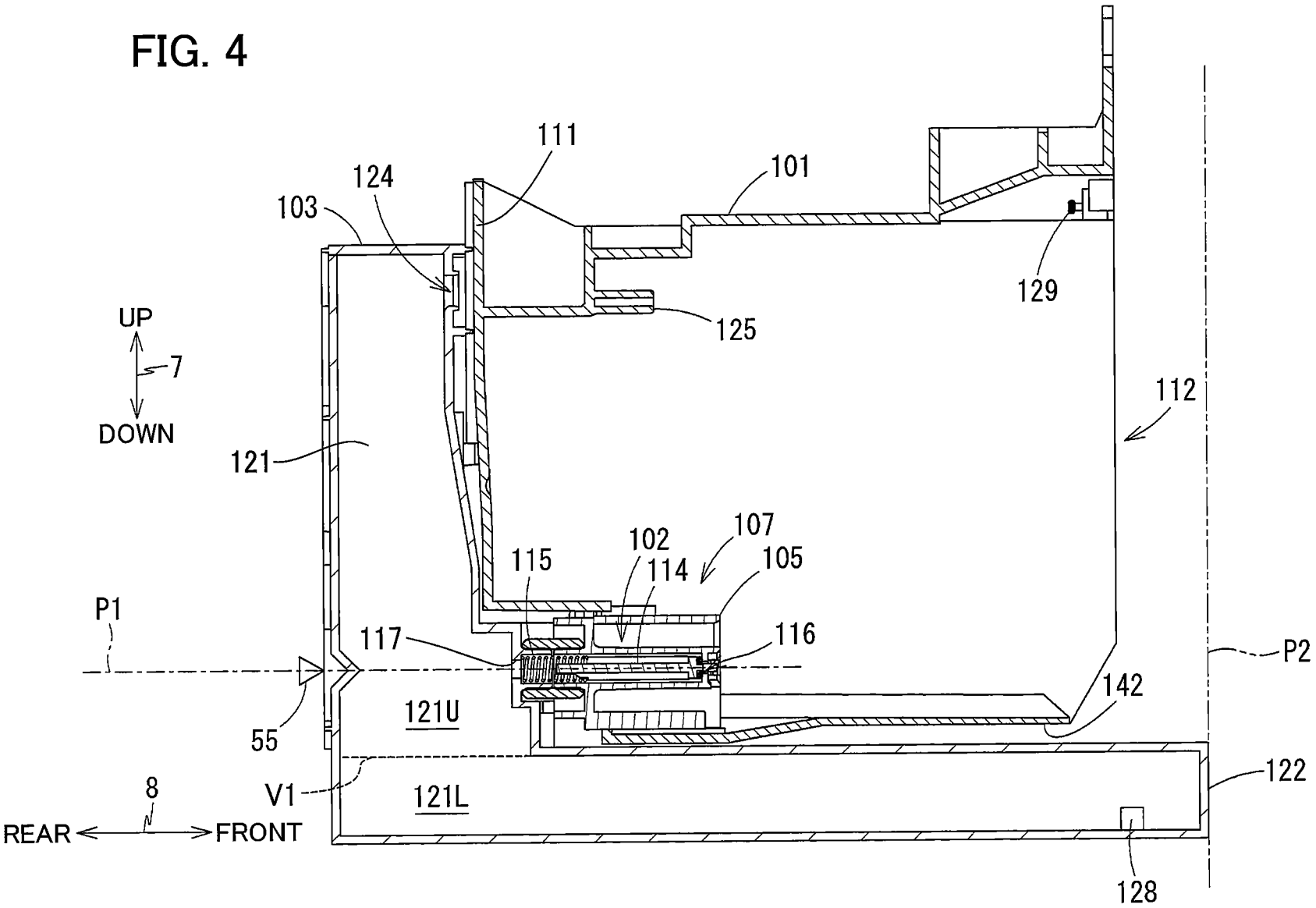
FIG. 4 is a vertical cross-sectional view of the cartridge receiving portion in the multifunction peripheral according to the first embodiment, the cartridge receiving portion including a tank.

The recording portion 24 includes a carriage 22 and a recording head 21 mounted on the carriage 22. The carriage 22 is reciprocally movable in the left-right direction 9 upon transmission of driving force from a drive motor (not illustrated). The recording head 21 has a lower surface at which a plurality of nozzles 29 are open. Each nozzle 29 is provided by an oscillation element such as a piezoelectric element, so that the oscillation causes ejection of ink droplet. During lateral movements of the carriage 22, ink droplets are selectively ejected from each nozzle 29 onto the sheet 12 supported on the platen 26 to thus form an inked image on the sheet 12. In the operable posture, the lower surface of the recording head 21 is positioned above a level of ink stored in an ink cartridge 30 attached to a cartridge receiving portion 110 (FIG. 3) and a level of ink stored in a tank 103 (FIGS. 3 and 4). Further, in the operable posture, the recording head 21 is positioned rearward of the cartridge receiving portion 110 in the front-rear direction 8.

A bundle of ink tubes (not illustrated) and a flexible flat cable (not illustrated) are connected to the carriage 22. The ink tubes connect the recording head 21 to the cartridge receiving portion 110 (FIG. 3). Specifically, each of the ink tubes is configured to supply ink stored in a corresponding ink cartridge 30 attached to the cartridge receiving portion 110 to the recording head 21. In the present embodiment, four ink cartridges 30 are attachable to the cartridge receiving portion 110. Accordingly, four ink tubes are provided in one-to-one correspondence with the four ink cartridges 30 so that ink of four colors (black, magenta, cyan, and yellow) stored in the respective four ink cartridges 30 can flow through the corresponding ink tubes 20. These ink tubes are bundled and connected to the recording head 21. The flexible flat cable is configured to electrically connect a control board (not illustrated) to the recording head 21. The control board is configured to control operations of the multifunction peripheral 10.

Cover 87

As illustrated in FIG. 1B, an opening 85 is formed in the front surface 14A of the casing 14 at a right end portion thereof in the left-right direction 9. A cover 87 is connected to the casing 14 so as to cover the opening 85. The cover 87 is supported by a lower end portion of the casing 14 so that the cover 87 is pivotally movable about a pivot axis extending in the left-right direction 9 at the lower end portion of the casing 14 between a closed position (a position illustrated in FIG. 1A) for closing the opening 85 and an open position (a position illustrated in FIG. 1B) for exposing the opening 85 to an outside. An accommodation space 86 is formed rearward of the opening 85 and inside the casing 14 for accommodating the cartridge receiving portion 110.

Cartridge Receiving Portion 110

As illustrated in FIGS. 3 and 4, the cartridge receiving portion 110 includes a cartridge case 101, four rods 125, a locking portion 129, four tanks 103, and four liquid-level sensors 55. Four ink cartridges 30 for the colors of cyan, magenta, yellow, and black can be accommodated in the cartridge receiving portion 110. Hence, four rods 125, four tanks 103, and four liquid-level sensors 55 are provided in the cartridge receiving portion 110 for four ink cartridges 30. In other words, each rod 125, each tank 103, and each liquid-level sensor 55 are provided for one-to-one correspondence with each ink cartridge 30. Incidentally, the ink cartridges 30 to be attached to the cartridge receiving portion 110 may differ in number. Further, FIG. 3 illustrates a state where one ink cartridge 30 is attached to a left end section of the cartridge receiving portion 110, while remaining three cartridges 30 are not attached to the cartridge receiving portion 110.

The cartridge case 101 constitutes a housing of the cartridge receiving portion 110. The cartridge case 101 has a box-like shape defining an internal space for accommodating the ink cartridges 30. The case 101 has a rear wall 111 in the front-rear direction 8, and an opening 112 formed at a position opposing the rear wall 111 in the front-rear direction 8. The opening 112 allows the internal space of the cartridge case 101 to be exposed to the outside. Further, the opening 112 is exposed to the outside of the multifunction peripheral 10 through the opening 85 of the casing 14 when the cover 87 is at the open position.

The ink cartridges 30 can be inserted rearward into and removed frontward from the cartridge receiving portion 110 in the front-rear direction 8 through the opening 85 of the casing 14 and the opening 112 of the cartridge case 101. As illustrated in FIG. 3, a bottom wall 142 of the cartridge case 101 is formed with four guide grooves 109. Movements of the ink cartridges 30 in the front-rear direction 8 are guided by the guide grooves 109 as lower end portions of the ink cartridges 30 are inserted into the respective guide grooves 109. As illustrated in FIG. 3, the cartridge case 101 has three plates 104 that partition the internal space of the cartridge case 101 into four individual spaces arrayed with each other in the left-right direction 9. Each of the four spaces partitioned by the plates 104 is configured to receive one of the four ink cartridges 30 of different colors.

Figure 7:
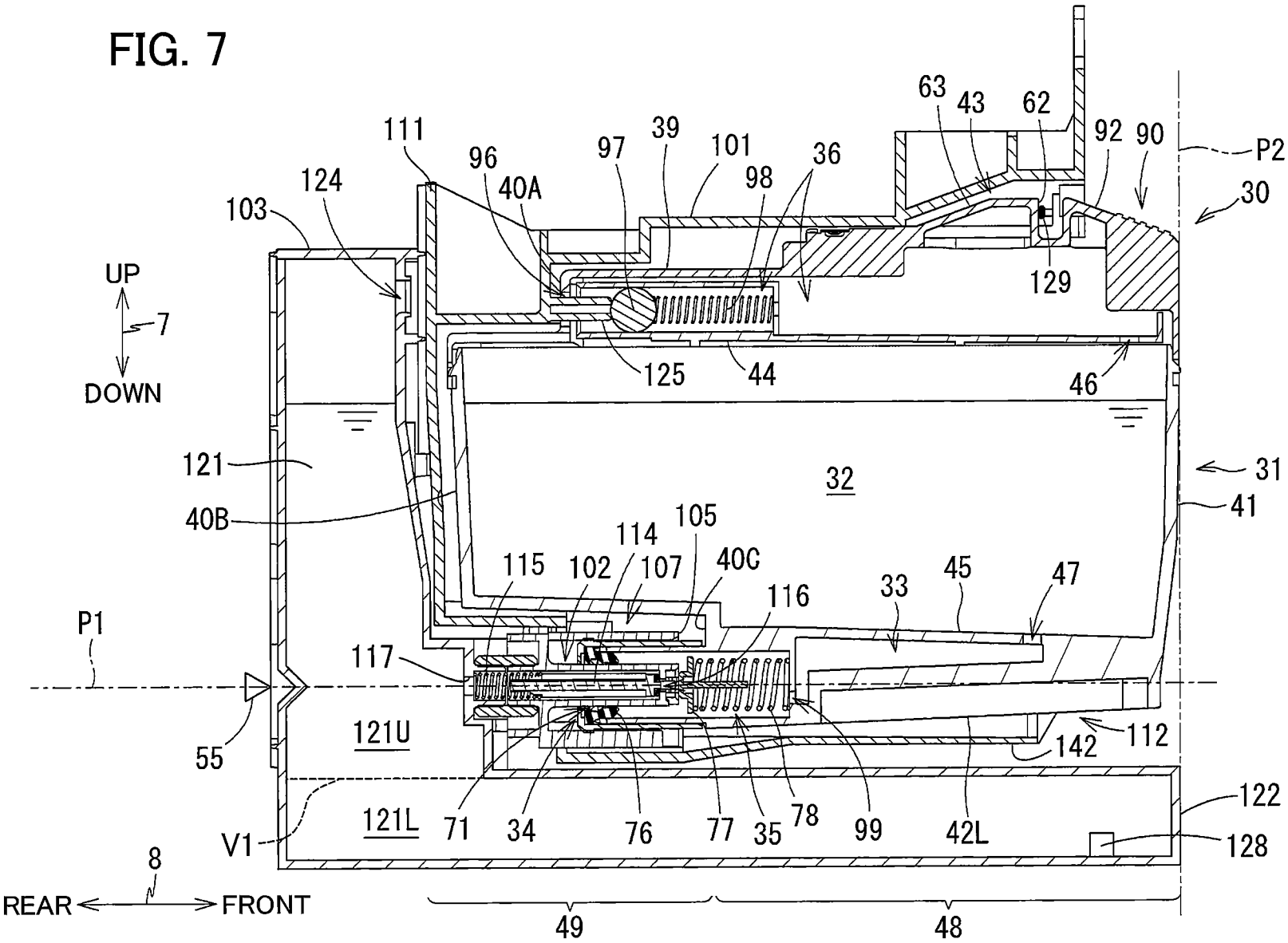
FIG. 7 is a vertical cross-sectional view illustrating the cartridge receiving portion and the ink cartridge attached thereto in the multifunction peripheral according to the first embodiment.
Figure 8:
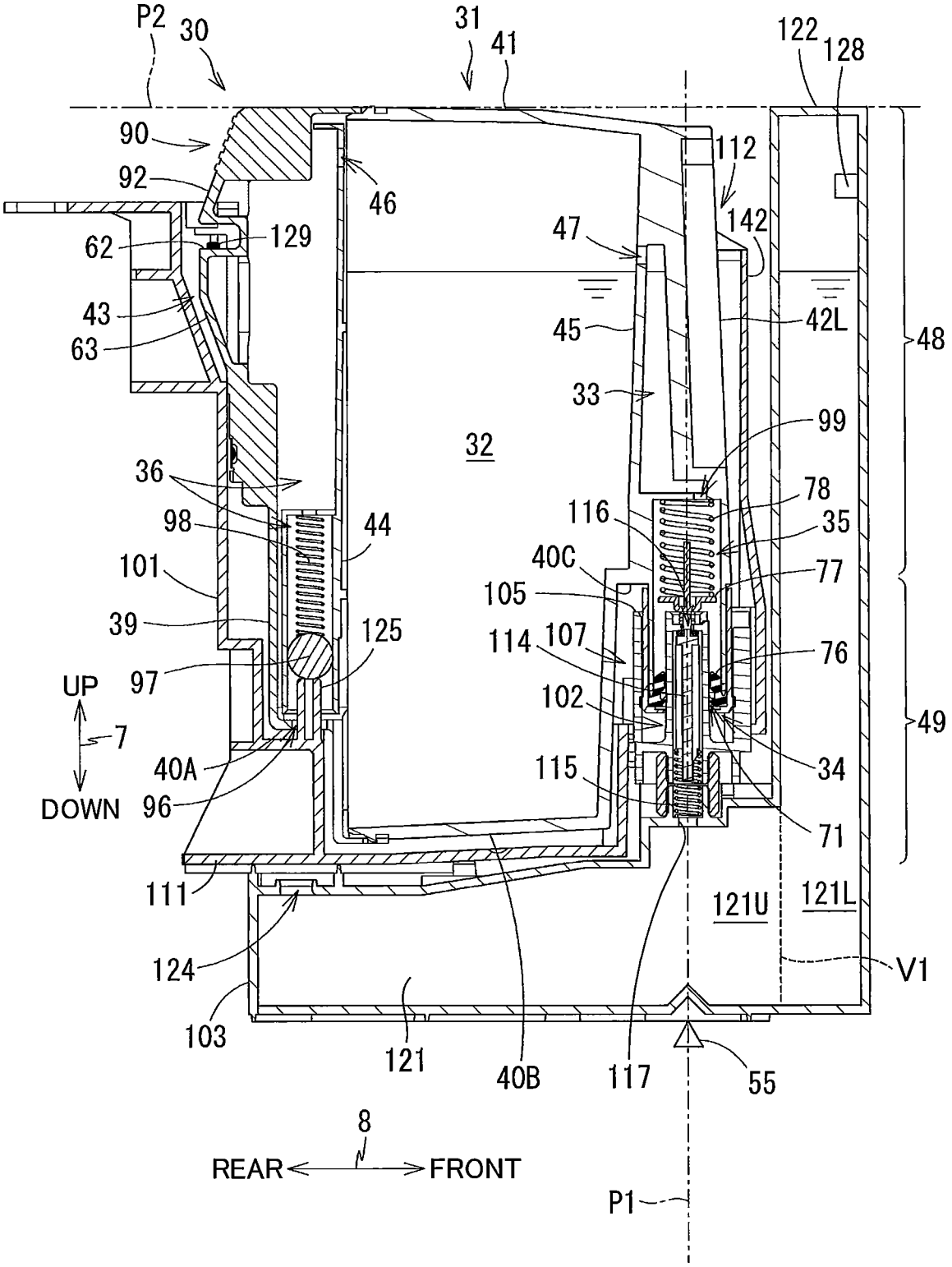
FIG. 8 is a vertical cross-sectional view illustrating the cartridge receiving portion and the ink cartridge attached thereto in the multifunction peripheral according to the first embodiment, the ink cartridge and cartridge receiving portion being disposed in such an orientation that an upper storage chamber and a lower storage chamber of the ink cartridge are positioned above an upper region of a storage chamber of the tank of the cartridge receiving portion.

The posture of the ink cartridge 30 depicted in FIGS. 3 and 7 is an attached posture of the ink cartridge 30 to the cartridge case 101.

Rods 125

As illustrated in FIG. 4, each rod 125 protrudes frontward from the rear wall 111 of the cartridge case 101. The rod 125 is positioned above a corresponding joint 107 (described later). The rod 125 is configured to be inserted into an air valve chamber 36 (FIG. 6, described later) of the ink cartridge 30 through an air communication opening 96 (FIG. 6, described later) of the ink cartridge 30 in a state where the ink cartridge 30 is attached to the cartridge receiving portion 110.

Locking Portion 129

As illustrated in FIGS. 3 and 4, the locking portion 129 is positioned adjacent to a top wall of the cartridge case 101 and adjacent to the opening 112 of the cartridge case 101. The locking portion 129 extends in the left-right direction 9. The locking portion 129 is a bar-like member extending in the left-right direction 9. For example, the locking portion 129 is a solid metal cylinder. The locking portion 129 has a left end fixed to a left end wall of the cartridge case 101 and a right end fixed to a right end wall of the cartridge case 101. The locking portion 129 extends in the left-right direction 9 over the four spaces of the cartridge case 101 in which the four ink cartridges 30 are respectively accommodatable.

The locking portion 129 is configured to retain each of the ink cartridges 30 attached to the cartridge case 101 at an attached position as illustrated in FIG. 7. In a state where the ink cartridges 30 are attached to the cartridge case 101, the ink cartridges 30 are respectively engaged with the locking portion 129. As a result, the locking portion 129 retains each ink cartridge 30 in the cartridge case 101 at the attached position against urging forces of coil springs 78, 98 (described later) that push the ink cartridge 30 frontward.

Tanks 103

As illustrated in FIG. 4, the tanks 103 are positioned below and rearward of the cartridge case 101. Among walls constituting each tank 103, a rear wall has a portion facing the corresponding liquid-level sensor 55 (described later). In the present embodiment, among the walls constituting each tank 103, at least this portion of the rear wall is configured to transmit light so that light emitted from the liquid-level sensor 55 can pass through this light transmissive portion of the rear wall. The light transmissive portion of the rear wall thus serves as a prism that functions in cooperation with the liquid-level sensor 55.

Each tank 103 has a box-like shape defining a storage chamber 121 therein. The storage chamber 121 includes an upper region 121U, and a lower region 121L positioned below the upper region 121U. The joint 107 (described later) is connected to the upper region 121U. The lower region 121L includes an outlet port 128 (described later). Incidentally, a boundary V1 between the upper region 121U and the lower region 121L is indicated by a broken line in FIG. 4.

The upper region 121U extends in the up-down direction 7 at a position rearward of the rear wall 111 of the cartridge case 101. The lower region 121L extends in the front-rear direction 8 at a position below the bottom wall 142 of the cartridge case 101. As illustrated in FIG. 7, in the state where the ink cartridge 30 is attached to the cartridge receiving portion 110, a lower wall 42 (FIG. 5) of the ink cartridge 30 is seated on the corresponding guide groove 109 (FIG. 3) formed in the bottom wall 142 of the cartridge case 101. Accordingly, the lower region 121L is positioned below a lowermost surface of the ink cartridge 30 (lower wall 42L), and extends along the lowermost surface of the ink cartridge 30. The lower region 121L extends away from the upper region 121U to protrude farther frontward relative to the upper region 121U in the front-rear direction 8. In other words, a front end of the lower region 121L is positioned frontward relative to a front end of the upper region 121U in the front-rear direction 8.

Figure 5:
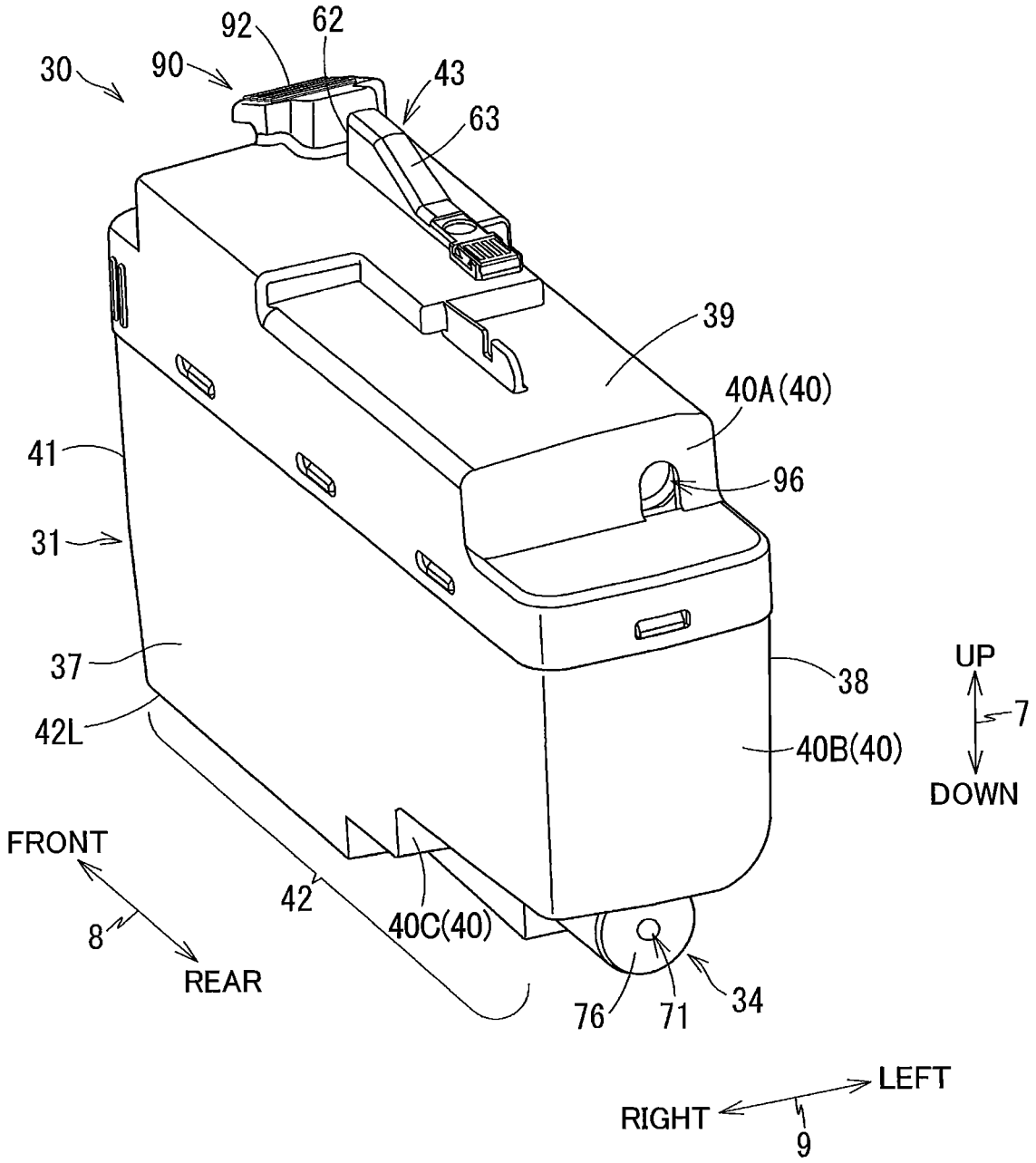
FIG. 5 is a perspective view of an ink cartridge as viewed from a rear side thereof attachable to the cartridge receiving portion in the multifunction peripheral according to the first embodiment.

In the present embodiment, the lowermost surface of the ink cartridge 30 is a lower surface 42L of the lower wall 42 constituting a cartridge casing 31 of the ink cartridge 30 (see FIG. 5). The lower surface 42L may be parallel to the front-rear direction 8, or may be inclined relative to the front-rear direction 8. Further, a protruding direction of the lower region 121L may not necessarily be parallel to the front-rear direction 8. That is, the expression "the lower region 121L extends along the lowermost surface of the ink cartridge 30" implies that the protruding direction of the lower region 121L and an extending direction of the lowermost surface of the ink cartridge 30 are generally parallel to the front-rear direction 8 as long as the protruding direction and the extending direction contain a component of the front-rear direction 8.

As illustrated in FIG. 7, the lower region 121L has a front wall 122 defining a front end of the lower region 121L. Hereinafter, a front surface of the front wall 122 will be simply referred to as a front surface 122. The front surface 122 of the lower region 121L is a frontmost surface of the lower region 121L in front-rear direction 8. That is, the front surface 122 is a surface constituting a most upstream end of the lower region 121L in an attachment direction of the ink cartridge 30 to the tank 103 (i.e., rearward direction). The most upstream end of the storage chamber 121 in the attachment direction of the ink cartridge 30 (i.e., a portion of the lower region 121L including the front surface 122) is positioned below the lowermost surface (lower surface 42L) of the ink cartridge 30 in a state where the ink supply portion 34 is connected to the joint 107. The front surface 122 is located at a position P2, i.e., generally at the same position as a front wall 41 of the ink cartridge 30 attached to the cartridge case 101 in the front-rear direction 8.

Although not specifically delineated in the drawings, a dimension of the upper region 121U in the left-right direction 9 is equal to a dimension of the lower region 121L in the left-right direction 9. Therefore, a (maximum) horizontal cross-sectional area of the lower region 121L is greater than a (maximum) horizontal cross-sectional area of the upper region 121U, because the lower region 121L has a dimension in the front-rear direction 8 that is greater than a dimension of the upper region 121U in the front-rear direction 8.

The storage chamber 121 is in communication with the corresponding ink tube (not illustrated) through the outlet port 128. The outlet port 128 is formed near a bottom wall defining a lower end of the lower region 121L. The outlet port 128 is positioned below the joint 107. Thus, the ink stored in the storage chamber 121 flows through the outlet port 128 into the ink tube and is supplied to the recording head 21 through the ink tube.

The upper region 121U has an upper portion formed with an air communication port 124. The air communication port 124 allows the storage chamber 121 to communicate with an atmosphere. Incidentally, the air communication port 124 may be opened or closed under control of the control board (not illustrated). Further, the air communication port 124 may be provided with a labyrinth channel (not illustrated) or a semipermeable membrane (not illustrated).

Joints 107

As illustrated in FIGS. 3 and 4, the joint 107 is provided at each tank 103. Each joint 107 includes an ink needle 102 and a guide portion 105. The ink needle 102 has a hollow tubular shape and made from resin, and a guide portion 105. The ink needle 102 protrudes frontward from the upper region 121U of the tank 103 to have a protruding end (front end) at which an opening 116 is formed. The ink needle 102 has a base end (rear end) in communication with an opening 117 formed in a wall defining the upper region 121U of the storage chamber 121. An internal space in the ink needle 102 is thus in communication with the upper region 121U of the storage chamber 121 through the opening 117. The opening 117 is positioned higher relative to the outlet port 128 in the direction 7. Further, the ink needle 102 is arranged at a position corresponding to a position of an ink supply portion 34 (FIG. 7) of the ink cartridge 30 attached to the cartridge receiving portion 110.

The guide portion 105 is a hollow cylindrical member provided to surround the ink needle 102. The guide portion 105 protrudes frontward from the tank 103 (upper region 121U) to have an open end. The ink needle 102 is positioned at a diametrical center of the guide portion 105. The ink supply portion 34 of the ink cartridge 30 is inserted into an interior of the guide portion 105 as the ink cartridge 30 is attached to the cartridge receiving portion 110.

In the internal space of the ink needle 102, a valve 114 and a coil spring 115 are accommodated. The valve 114 is movable in the front-rear direction 8 to open and close the opening 116 at the protruding end of the ink needle 102. The coil spring 115 urges the valve 114 to close the opening 116, that is, frontward. A front end portion of the valve 114 protrudes farther frontward relative to the opening 116.

Liquid-Level Sensors 55

Each liquid-level sensor 55 is configured to detect whether the level of the ink stored in the corresponding storage chamber 121 is equal to or lower than a threshold position P1 (see FIG. 7). Specifically, the liquid-level sensor 55 is configured to output a low level signal to the control board (not shown) when the level of the ink stored in the storage chamber 121 is higher than the threshold position P1. Further, the liquid-level sensor 55 is configured to output a high level signal to the control board (not shown) when the level of the ink stored in the storage chamber 121 is equal to or lower than the threshold position P1. The liquid level sensor 55 is an optical sensor making use of the prism (light transmissive portion of the rear wall of the tank 103) which provides an optical reflectivity that varies depending on whether the ink stored in the storage chamber 121 is in contact with the prism of the storage chamber 121.

The control board (not shown) of the multifunction peripheral 10 is configured to determine whether the ink cartridge 30 is empty (cartridge empty), which implies that ink can be no longer supplied from the ink cartridge 30, upon receipt of a high-level signal from the liquid-level sensor 55. Further, the control board may be configured to count an amount of ink ejected from the recording head 21 on a basis of print data after receipt of the high-level signal from the liquid level sensor 55 to determine whether the level of the ink stored in the storage chamber 121 becomes lower than the boundary V1 between the upper region 121U and the lower region 121L to thus determine that the storage chamber 121 is in an "ink empty state". In the ink empty state, the image recording operations are halted in order to avoid entry of air into the outlet port 128 due to lowering of the level of the ink stored in the storage chamber 121. Accordingly, in the ink empty state, the ink may remain in the storage chamber 121.

Note that the ink level to be detected by the liquid-level sensor 55 may not be at the threshold position P1. For example, the liquid-level sensor 55 may be configured to output a high level signal based on whether the level of the ink in the storage chamber 121 is at the boundary V1 between the upper region 121U and the lower region 121L. In this case, the control board may determine that the storage chamber 121 is in the ink empty state upon receipt of the high-level signal from the liquid-level sensor 55.

Incidentally, other conventional structures may also be available as the liquid-level sensor 55. For example, an actuator having a detected element may be positioned in the storage chamber 121. This actuator may be configured to pivotally move when the level of the ink stored in the storage chamber 121 becomes lower than the threshold position P1, so that vertical position of the detected element can vary according to the level of the ink stored in the storage chamber 121. Thus, determination as to whether the level of the ink is lower than the threshold position P1 can be made by detecting the position of the detected element by an optical sensor. Alternatively, electrodes may be inserted into the storage chamber 121 to detect the level of the ink stored in the storage chamber 121.

Ink Cartridges 30

Each ink cartridge 30 is a container for storing ink therein. The ink cartridge 30 includes the cartridge casing 31, a projecting portion 43, and an operation portion 90. As illustrated in FIG. 5, the cartridge casing 31 is substantially rectangular parallelepiped shaped. Specifically, the cartridge casing 31 has a generally flattened shape as a whole such that dimensions of the cartridge casing 31 in the up-down direction 7 and in the front-rear direction 8 are greater than a dimension thereof in the left-right direction 9. Note that external dimensions of ink cartridges 30 for different colors may be identical to each other, or may be different from each other.

The cartridge casing 31 defines an internal space therein for storing ink. Specifically, the cartridge casing 31 includes a rear wall 40, the front wall 41, an upper wall 39, the lower wall 42, a right wall 37, and a left wall 38.

Figure 6:
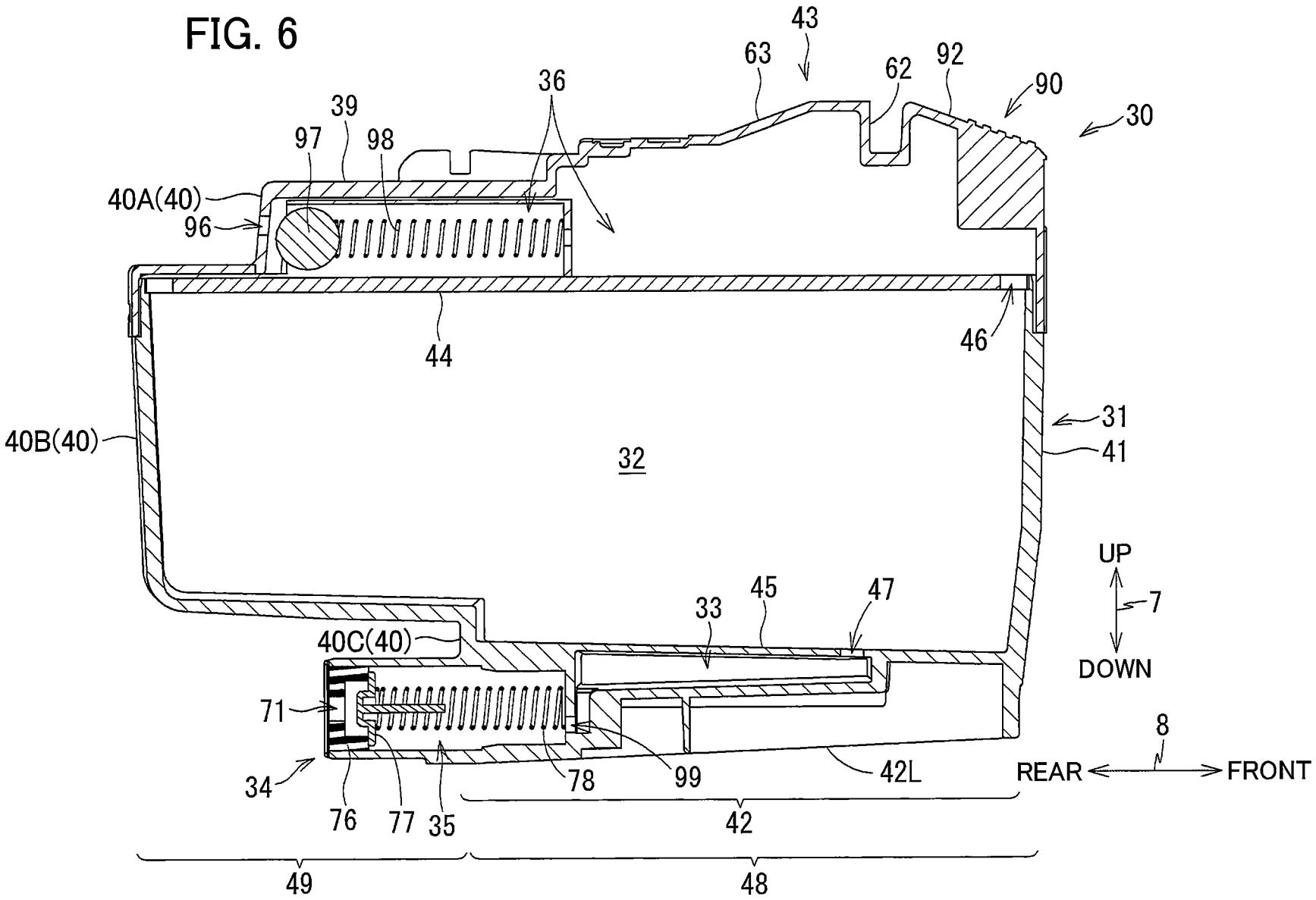
FIG. 6 is a vertical cross-sectional view of the ink cartridge attachable to the cartridge receiving portion in the multifunction peripheral according to the first embodiment.

As illustrated in FIGS. 5 and 6, the rear wall 40 includes a first rear wall 40A, a second rear wall 40B, and a third rear wall 40C. The first rear wall 40A is positioned frontward of and upward of the second rear wall 40B. The second rear wall 40B is positioned rearward of and upward of the third rear wall 40C. Further, the third rear wall 40C is positioned frontward of and downward of the first rear wall 40A. The first rear wall 40A is formed with the air communication opening 96. Further, the ink supply portion 34 extends rearward from the third rear wall 40C.

As illustrated in FIG. 6, the cartridge casing 31 can be divided into a base portion 48 and a protruding portion 49. Specifically, the base portion 48 is defined by a frontward portion of the upper wall 39, the front wall 41, the lower wall 42, the third rear wall 40C, and frontward portions of the right side wall 37 and the left side wall 38. The protruding portion 49 is defined by a rearward portion of the upper wall 39, the first rear wall 40A, the second rear wall 40B, and rearward portions of the right and left side walls 37, 38.

That is, the protruding portion 49 protrudes rearward from a part of the base portion 48. Specifically, the protruding portion 49 protrudes rearward from an upper part of the base portion 48. A boundary between the base portion 48 and the protruding portion 49 in front-rear direction 8 may be, for example, an extension line of the first rear wall 40A, or an extension line of the third rear wall 40C, or an imaginary line connecting a lower end of the first rear wall 40A to an upper end of the third rear wall 40C.

The projecting portion 43 and the operation portion 90 are provided at the upper wall 39. The projecting portion 43 protrudes upward from an outer surface (upper surface) of the upper wall 39 and extends in the front-rear direction 8. The projecting portion 43 has a lock surface 62 facing frontward. The lock surface 62 is positioned upward relative to the upper wall 39. The lock surface 62 is configured to contact the locking portion 129 of the cartridge receiving portion 110 in the state where the ink cartridge 30 is attached to the cartridge receiving portion 110. Contact of the lock surface 62 with the locking portion 129 allows the ink cartridge 30 to be retained at the attached position against the urging force of the coil springs 78, 98.

The operation portion 90 is provided on the upper wall 39 at a position frontward relative to the lock surface 62. The operation portion 90 has an operation surface 92. When the operation surface 92 is pressed downward by the user in the state where the ink cartridge 30 is attached to the cartridge receiving portion 110, the ink cartridge 30 is pivotally moved to move the lock surface 62 downward. As a result, the lock surface 62 is positioned further downward relative to the locking portion 129. The ink cartridge 30 is thus allowed to be removed from the cartridge receiving portion 110.

In the internal space of the cartridge casing 31, an upper storage chamber 32, a lower storage chamber 33, an ink valve chamber 35, and the air valve chamber 36 are defined. The upper storage chamber 32, the lower storage chamber 33, and the ink valve chamber 35 are adapted to store ink therein. The air valve chamber 36 provides communication between the atmosphere and the upper storage chamber 32.

In the internal space of the cartridge casing 31, the upper storage chamber 32 and the lower storage chamber 33 are portioned by a partition wall 45. The upper storage chamber 32 and the lower storage chamber 33 are aligned with each other in the up-down direction 7. Further, the upper storage chamber 32 and the lower storage chamber 33 are in communication with each other through a through-hole 47 formed in the partition wall 45. The upper storage chamber 32 has an internal volume greater than those of the lower storage chamber 33 and the ink valve chamber 35. The upper storage chamber 32 spans between the base portion 48 and the protruding portion 49 in the front-rear direction 8.

The upper storage chamber 32 and the air valve chamber 36 are partitioned by a partition wall 44. The upper storage chamber 32 and the air valve chamber 36 are positioned to be aligned with each other in the up-down direction 7. The upper storage chamber 32 and the air valve chamber 36 are in communication with each other through a through-hole 46 formed in the partition wall 44.

The lower storage chamber 33 is positioned frontward relative to the ink valve chamber 35. The lower storage chamber 33 and the ink valve chamber 35 are in communication with each other through a through-hole 99 formed in a wall partitioning the lower storage chamber 33 from the ink valve chamber 35. A sum of the internal volumes of the lower storage chamber 33 and the ink valve chamber 35 is smaller than an internal volume of the storage chamber 121 of the corresponding tank 103.

The air valve chamber 36 is an air channel positioned above the upper storage chamber 32. A labyrinth channel (not illustrated) or a semipermeable membrane may be provided at the air valve chamber 36. A valve 97 and a coil spring 98 are accommodated in the air valve chamber 36. The valve 97 is movable between a closed position closing the air communication opening 96 and an open position opening the air communication opening 96. The coil spring 98 urges the valve 97 toward the closed position, i.e., rearward to close the air communication opening 96.

In a process of attaching the ink cartridge 30 to the cartridge receiving portion 110, the rod 125 (FIG. 7) of the cartridge receiving portion 110 enters into the air valve chamber 36 through the air communication opening 96. The rod 125 inserted into the air valve chamber 36 contacts the valve 97 to move the valve 97 frontward against the urging force of the coil spring 98. The upper storage chamber 32 thus becomes communicated with the atmosphere by the movement of the vale 97 to the open position. Incidentally, a structure for allowing the upper storage chamber 32 to communicate with the atmosphere is not limited to the structure of this embodiment. As an alternative, a film may be provided to seal the air communication opening 96, so that the rod 125 may break through the film upon entry into the air communication opening 96.

The ink supply portion 34 protrudes rearward from the third rear wall 40C. Specifically, the ink supply portion 34 is preferably provided below a lower end of the protruding portion 49 and at a surface of the base portion 48, the surface facing rearward. The ink supply portion 34 is hollow cylindrical in shape. The ink supply portion 34 defines an inner space therein serving as the ink valve chamber 35. A protruding end (rear end) of the ink supply portion 34 is open to the outside of the ink cartridge 30. The second rear wall 40B is positioned farther rearward relative to the protruding end of the ink supply portion 34. The ink valve chamber 35 accommodates therein a seal member 76, a valve 77, and the coil spring 78.

The seal member 76 is provided in a rear end portion of the ink supply portion 34. The seal member 76 is a disc-shaped elastic member formed with an ink supply port 71 at a radially center portion thereof. The ink supply port 71 extends through a thickness of the disc-shaped seal member 76 in the front-rear direction 8. The ink supply port 71 has an inner diameter slightly smaller than an outer diameter of the ink needle 102. The valve 77 is configured to move in the front-rear direction 8 between a closed position and an open position. In the closed position, the valve 77 is in abutment with the seal member 76 for closing the ink supply port 71, while in the open position, the valve 77 is moved away from the seal member 76 for opening the ink supply port 71. The coil spring 78 urges the valve 77 in a direction toward the closed position, i.e., rearward, to close the ink supply port 71.

In the process of attaching the ink cartridge 30 to the cartridge receiving portion 110, the ink needle 102 of the cartridge receiving portion 110 enters into the ink valve chamber 35 through the ink supply port 71. At this time, an outer peripheral surface of the ink needle 102 provides liquid-tight contact with an inner peripheral surface of the ink supply port 71 while elastically deforming the seal member 76. As the tip end (front end) of the ink needle 102 passes through the seal member 76 and advances further into the ink valve chamber 35, the tip end of the ink needle 102 abuts on the valve 77, thereby moving the valve 77 to the open position against the urging force of the coil spring 78. While the tip end of the ink needle 102 abuts on the valve 77, the valve 77 abuts on the valve 114 in the ink needle 102 and pushes the valve 114 rearward against the urging force of the coil spring 115 to open the opening 116 of the ink needle 102.

As a result, as illustrated in FIG. 7, the ink supply port 71 and the opening 116 are opened respectively, thereby allowing communication of ink between the ink valve chamber 35 of the ink supply portion 34 and the internal space of the ink needle 102. This state is one example of a connection state of the ink supply portion 34 to the joint 107. Consequently, the ink stored in the upper storage chamber 32 and the lower storage chamber 33 of the ink cartridge 30 can be supplied to the storage chamber 121 of the tank 103 due to water head difference through the ink supply portion 34 and the joint 107 connected to each other.

Further, as illustrated in FIG. 7, the ink cartridge 30 and the tank 103 provide the following positional relationship in the attached state of the ink cartridge 30 to the cartridge receiving portion 110, i.e., in the state where the ink supply portion 34 is connected to the joint 107.

The lower region 121L of the storage chamber 121 of the tank 103 is overlapped with the lower surface 42L of the lower wall 42 of the cartridge casing 31 of the ink cartridge 30 when viewed in the up-down direction 7. Here, the term "overlapped with" also implies overlapping between a portion of the lower region 121L and a portion of the lower surface 42L. In the present embodiment, the lower region 121L of the tank 103 and the lower surface 42L of the ink cartridge 30 are aligned with each other in the up-down direction 7.

The outlet port 128 of the tank 103 is positioned farther frontward away from the upper region 121U than the through-hole 99 is from the upper region 121U in the front-rear direction 8.

Further, in the embodiment, in the state where the ink supply portion 34 is connected to the joint 107, the front wall 41 of the ink cartridge 30 is at the position P2, i.e., at the same position as the front surface 122 of the lower region 121L of the corresponding tank 103 in the front-rear direction 8, as illustrated in FIG. 7. That is, the front wall 41 of the ink cartridge 30 is a surface constituting a most upstream end of the ink cartridge 30 in the attachment direction of the ink cartridge 30 to the tank 103 (i.e., rearward direction).

Operational and Technical Advantages in First Embodiment

According to the first embodiment, even after the ink to be supplied from the upper storage chamber 32, the lower storage chamber 33, and the ink valve chamber 36 of the ink cartridge 30 to the storage chamber 121 of the tank 103 is full consumed, the ink stored in the storage chamber 121 (more specifically, the ink positioned below the threshold position P1 in the storage chamber 121) can still be supplied to the recording head 21 and can be ejected therefrom. Further, the volume of the lower region 121L of the storage chamber 121 can be increased by making use of a space below the lower wall 42 of the ink cartridge 30 without shortage of space for the ink cartridge 30 and the cartridge receiving portion 110.

According to the first embodiment, the protruding portion 49 of the ink cartridge 30 is positioned to face the upper region 121U of the storage chamber 121 in the front-rear direction 8, the upper region 121U being set back from the lower region 121L. Hence, proper lay out of the ink cartridge 30 and the cartridge receiving portion 110 can be realized without increase in size of the multifunction peripheral 10.

The outlet port 128 of the tank 103 is positioned farther frontward away from the upper region 121U than the through-hole 99 is from the upper region 121U in the front-rear direction 8. Here, assume that the multifunction peripheral 10 is erroneously installed in a posture illustrated in FIG. 8 such that the rear surface of the multifunction peripheral 10 is placed on a horizontal surface as a lowermost surface so that both the upper storage chamber 32 and the lower storage chamber 33 of the ink cartridge 30 are positioned above the upper region 121U of the storage chamber 121 of the tank 103. With this posture, the recording head 21 is positioned lower than the outlet port 128 of the tank 103. Accordingly, if ink meniscus formed at the nozzle 29 of the recording head 21 is broken, the ink stored in the storage chamber 121 of the tank 103 may flow toward the recording head 21 through the outlet port 128, so that the ink may leak out of the nozzle 29. However, according to the structure of the first embodiment, the outlet port 128 of the tank 103 is positioned higher than the through-hole 99 even in the erroneous posture illustrated in FIG. 8. Hence, this arrangement of the first embodiment can reduce the amount of ink flowing from the storage chamber 121 to the recording head 21 through the outlet port 128.

Modifications to First Embodiment

Figure 9:
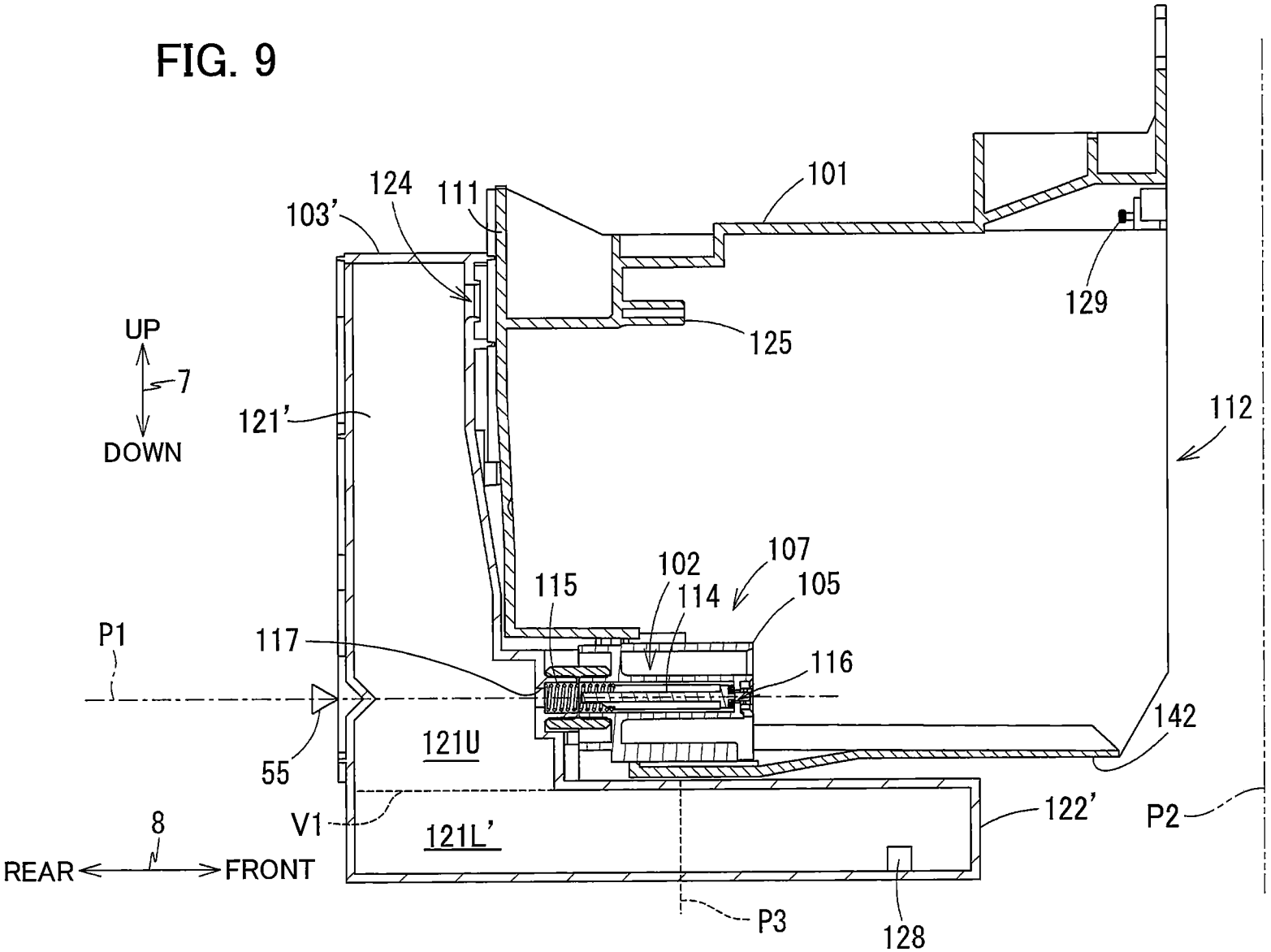
FIG. 9 is a vertical cross-sectional view illustrating a cartridge receiving portion and an ink cartridge attached thereto in a multifunction peripheral according to a variation of the first embodiment.

According to the first embodiment, the front surface 122 of the tank 103 is at the position P2. However, the front surface 122 of the tank 103 may not necessarily be positioned at the position P2 of the first embodiment, provided that the front surface 122 is positioned frontward relative to the upper region 121U in the front-rear direction 8. For example, the front surface 122 of the tank 103 may be positioned farther frontward relative to the position P2. Still alternatively, the front surface 122 of the tank 103 may be positioned farther rearward relative to the position P2, as depicted in FIG. 9. In a variation of the first embodiment shown in FIG. 9, a tank 103' defines therein a storage chamber 121' configured of the upper region 121U and a lower region 121L'. The lower region 121L' of this variation extends frontward up to a position P3 (indicated by a broken line in FIG. 9) that is farther rearward relative to the position P2 of the embodiment. That is, a front surface 122' of the lower region 121L' is positioned at the position P3 farther rearward relative to the position P2 of the embodiment.

In the first embodiment, an entirety of the lower region 121L overlaps with the lower surface 42L of the ink cartridge 30 when viewed in the up-down direction 7. However, the lower region 121L of the storage chamber 121 of the tank 103 may not fully overlap with the lower surface 42L of the lower wall 42 of the cartridge case 31 of the ink cartridge 30 when viewed in the up-down direction 7. In other words, the lower region 121L may have at least a portion that overlaps with the lower surface 42L of the lower wall 42 when viewed in the up-down direction 7.

Further, the boundary V1 between the upper region 121U and the lower region 121L of the storage chamber 121 of the tank 103 may not necessarily be at the position (height) indicated by the broken line in FIG. 4. For example, the lower region 121L may have a lower portion that extends farther frontward relative to the upper region 121U, while an upper portion of the lower region 121L does not protrude frontward from the upper region 121U. In other words, the lower region 121L may have at least a portion that protrudes farther frontward relative to the upper region 121U.

Further, the outlet port 128 of the tank 103 may not necessarily be positioned farther away from the upper region 121U than the through-hole 99 is from the upper region 121U in the front-rear direction 8. For example, the outlet port 128 may be positioned rearward relative to the through-hole 99.

Further, in the first embodiment, the lower surface 42L of the lower wall 42 is the lowermost surface of the ink cartridge 30 in the attached state of the ink cartridge 30 to the cartridge receiving portion 110. However, the lowermost surface of the ink cartridge 30 may not necessarily be the lower surface 42L. For example, a lower surface of the ink supply portion 34 may be the lowermost surface of the ink cartridge 30 in the attached state of the ink cartridge 30 to the cartridge receiving portion 110.

2. Second Embodiment

A multifunction peripheral 10A as a liquid ejection device according to a second embodiment will next be described with reference to FIGS. 10A to 12.

Figure 10A:
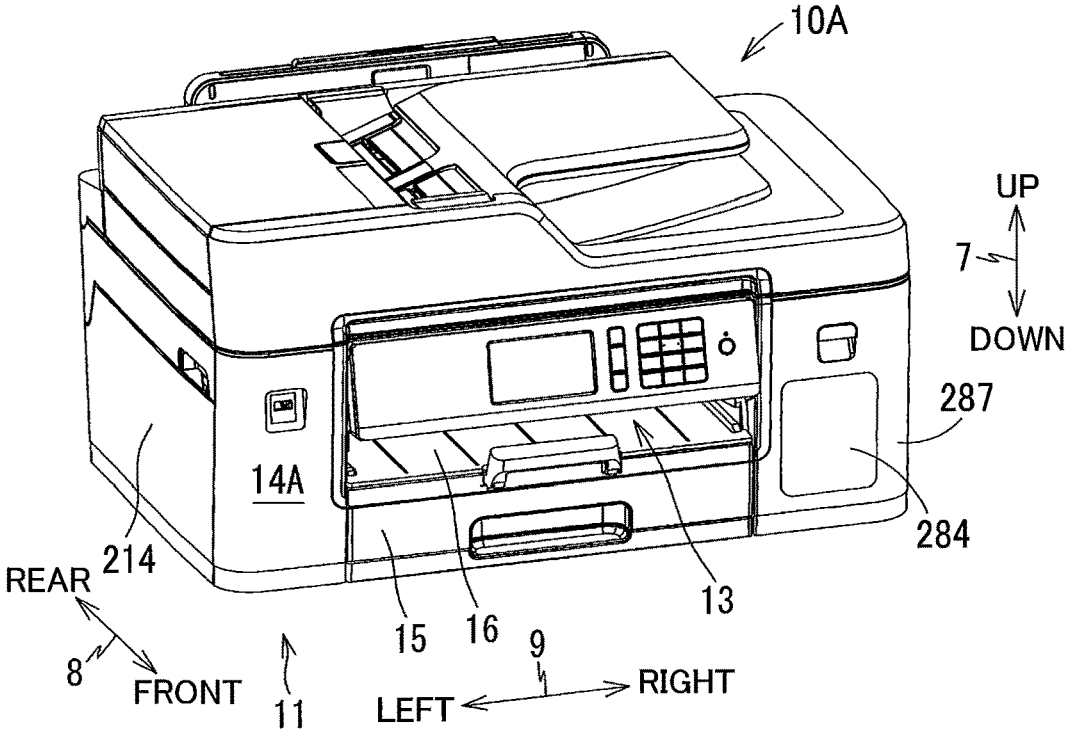
FIG. 10A is a perspective view of a multifunction peripheral according to a second embodiment of the present disclosure, in which a cover of the multifunction peripheral is at a closed position.
Figure 10B:
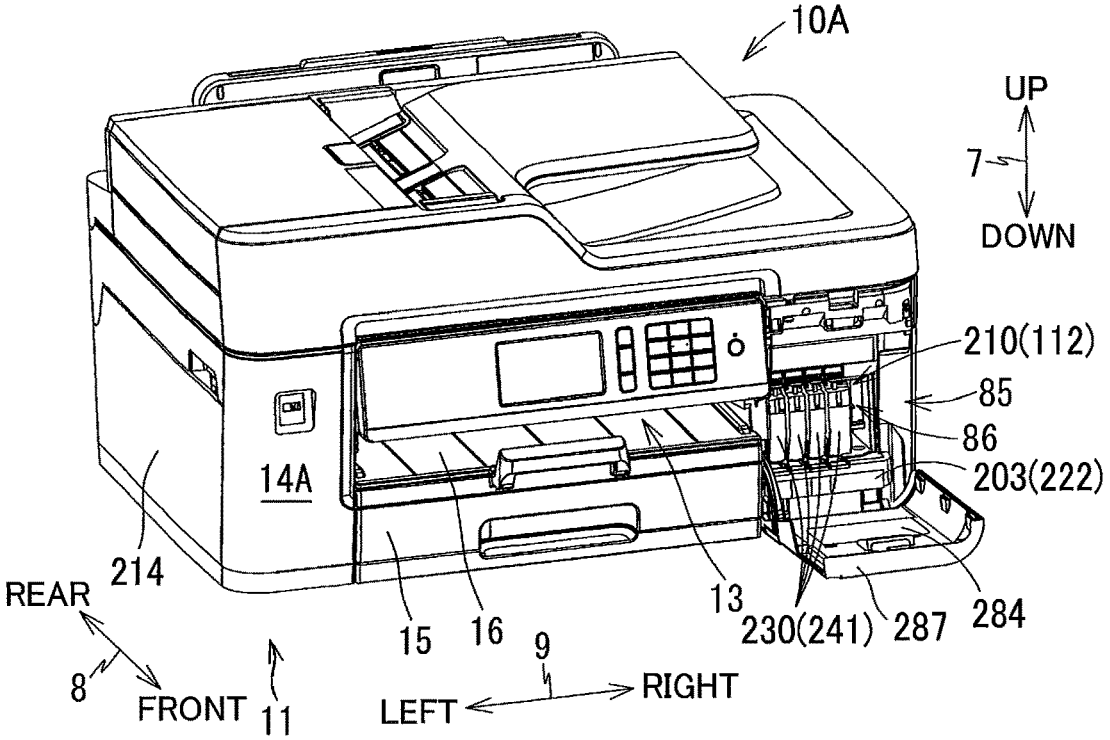
FIG. 10B is a perspective view of the multifunction peripheral according to the first embodiment, in which the cover is at an open position.

The multifunction peripheral 10A of the second embodiment includes a casing 214 that is provided with a cover 287, in place of the cover 87 of the first embodiment. As illustrated in FIGS. 10A and 10B, the cover 287 is formed with a window 284 which is capable of transmitting light therethrough.

The multifunction peripheral 10A of the second embodiment includes a cartridge receiving portion 210 configured to receive four ink cartridges 230. The ink cartridge 230 has the same structure as the ink cartridge 30 of the first embodiment, except that at least a front wall 241 of a cartridge casing 231 of the ink cartridge 230 is capable of transmitting light therethrough. Since the front wall 241 is light transmissive, the level of ink stored in the upper storage chambers 32 and lower storage chamber 33 of the ink cartridge 230 can be visually confirmed through the front wall 241.

Figure 11:
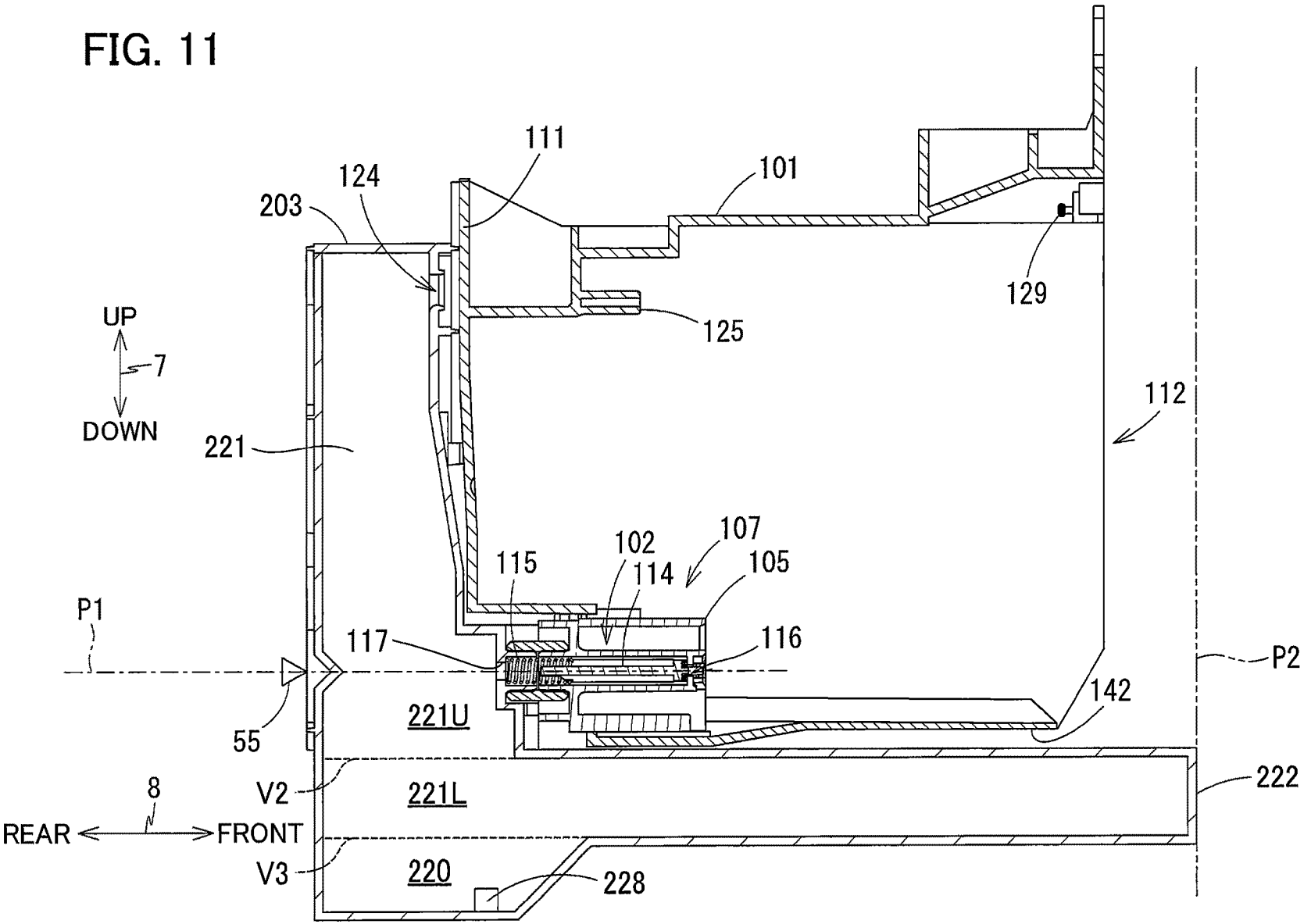
FIG. 11 is a vertical cross-sectional view of a cartridge receiving portion in the multifunction peripheral according to the second embodiment.

The cartridge receiving portion 210 of the second embodiment includes four tanks 203 corresponding to the four ink cartridges 230. As illustrated in FIG. 11, each tank 203 defines a storage chamber 221 therein. The storage chamber 221 includes an upper region 221U, a lower region 221L, and a lowermost region 220. The upper region 221U and lower region 221L correspond to the upper region 121U and the lower region 121L of the first embodiment, respectively. The lower region 221L has a front wall 222 defining the front end of the lower region 221L in the front-rear direction 8. This front wall 222 is capable of transmitting light therethrough so that the user can visually confirm a level of the ink stored in the storage chamber 221 through the front wall 222. A front surface of this front wall 222 will be referred to as a tank visual-recognition surface 222, hereinafter.

The lowermost region 220 is positioned below the lower region 221L. That is, the lowermost region 220 is positioned below the tank visual-recognition surface 222 of the lower region 221L. An outlet port 228 is formed at a bottom of the lowermost region 220. The storage chamber 221 is in communication with the ink tube (not illustrated) through the outlet opening 228. The ink stored in the storage chamber 221 is flowed out of the outlet opening 228 and is supplied to the recording head 21 through the ink tube. The lowermost region 220 has a horizontal cross-sectional area smaller than that of the lower region 221L. Note that, the horizontal cross-sectional area of the lowermost region 220 may be equal to or greater than a horizontal cross-sectional area of the lower region 221L.

In a state where the ink cartridge 230 is attached to the cartridge receiving portion 210 and the cover 287 is closed, the front wall 241 of each ink cartridge 230 and tank visual-recognition surface 222 of each tank 203 are visible through the opening 112 of the cartridge case 101 and the window 284. That is, the window 284 of the cover 287 spans in the up-down direction 7 from the front wall 241 of the ink cartridge 230 to a position below the opening 112 of the cartridge case 101.

In a state where the ink cartridge 30 is attached to the cartridge receiving portion 210, the front wall 241 of the ink cartridge 230 faces frontward and is exposed to the outside through the opening 112 of the cartridge case 101 (see FIG. 3). As illustrated in FIG. 10B, the front wall 241 of the ink cartridge 230 and the tank visual-recognition surface 222 of each tank 203 face frontward and are exposed to the outside in a state where the cover 287 is at its open position for opening the opening 85 of the casing 214. Accordingly, the user who faces the front surface 14A of the multifunction peripheral 10A can visually recognize the level of the ink stored in the upper storage chamber 32 and the lower storage chamber 33 through the front wall 241 of the attached ink cartridge 230. Further, the user can also visually recognize the level of the ink stored in the lower region 221L through the tank visual-recognition surface 222 of each tank 203.

Further, as illustrated in FIG. 10A, even in a state where the cover 287 is at its closed state for closing the opening 85 of the casing 214, the front wall 241 of the ink cartridge 230 and the tank visual-recognition surface 222 of the tank 203 are visible from the outside through the window 284 of the cover 287. Accordingly, even in the state where the cover 287 closes the opening 85, the user who faces the front surface 14A of the multifunction peripheral 10A can visually recognize the level of the liquid stored in the upper storage chamber 32 and the lower storage chamber 33 through the front wall 241 of the ink cartridge 230 and through the window 284 of the closed cover 287. Further, the user can also visually recognize the level of the ink stored in the lower region 221L through the tank-visual recognition surface 222 of the tank 203 and through the window 284 of the closed cover 287.

In the second embodiment, a control board (not shown) of the multifunction peripheral 10A is configured to determine whether the ink cartridge 230 is empty (cartridge empty), which implies that ink can be no longer supplied from the ink cartridge 230, upon receipt of a high-level signal from the liquid-level sensor 55 indicating that the level of ink in the storage chamber 221 is at the threshold position P1. Further, the control board is configured to count an amount of ink ejected from the recording head 21 on a basis of print data after receiving the high-level signal from the liquid-level sensor 55, thereby determining whether the level of the ink stored in the storage chamber 221 becomes lower than a boundary V3 between the lower region 221L and the lowermost region 220 (i.e., whether the storage chamber 221 is in its "ink empty state"). In the ink empty state, image recording operations are halted in order to avoid entry of air into the outlet port 228 due to the decline in the level of the ink stored in the storage chamber 221. Accordingly, in the ink empty state, the ink may remain in the storage chamber 221. Incidentally, the level of the ink in the storage chamber 221 at the time of the ink empty state may be at a position in the lowermost region 220 lower than the boundary V3, provided that the level is higher than the outlet port 228. Note that, the ink level to be detected by the liquid-level sensor 55 may not necessarily be at the threshold position P1. For example, the liquid-level sensor 55 may be configured to detect whether the level of the ink in the storage chamber 221 is at a boundary V2 between the upper region 221U and the lower region 221L.

Operational and Technical Advantages in Second Embodiment

In addition to the technical advantages of the first embodiment, the multifunction peripheral 10A of the second embodiment can further achieve the following technical advantages.

According to the second embodiment, since the tank visual-recognition surface 222 is light transmissive, the state of the ink stored in the storage chamber 221 can be visually recognized from the outside of the casing 214 through the tank visual-recognition surface 222. Particularly, the state of the ink stored in the lower region 221L of the storage chamber 221 after termination of ink supply from the ink cartridge 30 can be recognized from the outside of the casing 214.

In a state where the level of the ink stored in the storage chamber 221 becomes lower than the boundary V3 between the lower region 221L and the lowermost region 220, that is, "ink empty state" occurs, the level of ink left in the lowermost region 220 cannot be visually confirmed through the tank visual-recognition surface 222, since the lowermost region 220 is located below the tank visual-recognition surface 222. Accordingly, the user can intuitively understand the "ink empty state" through the tank visual-recognition surface 222. Further, entry of air into the recording head 21 through the outlet port 228 of the lowermost region 220 can be restrained.

Figure 12:
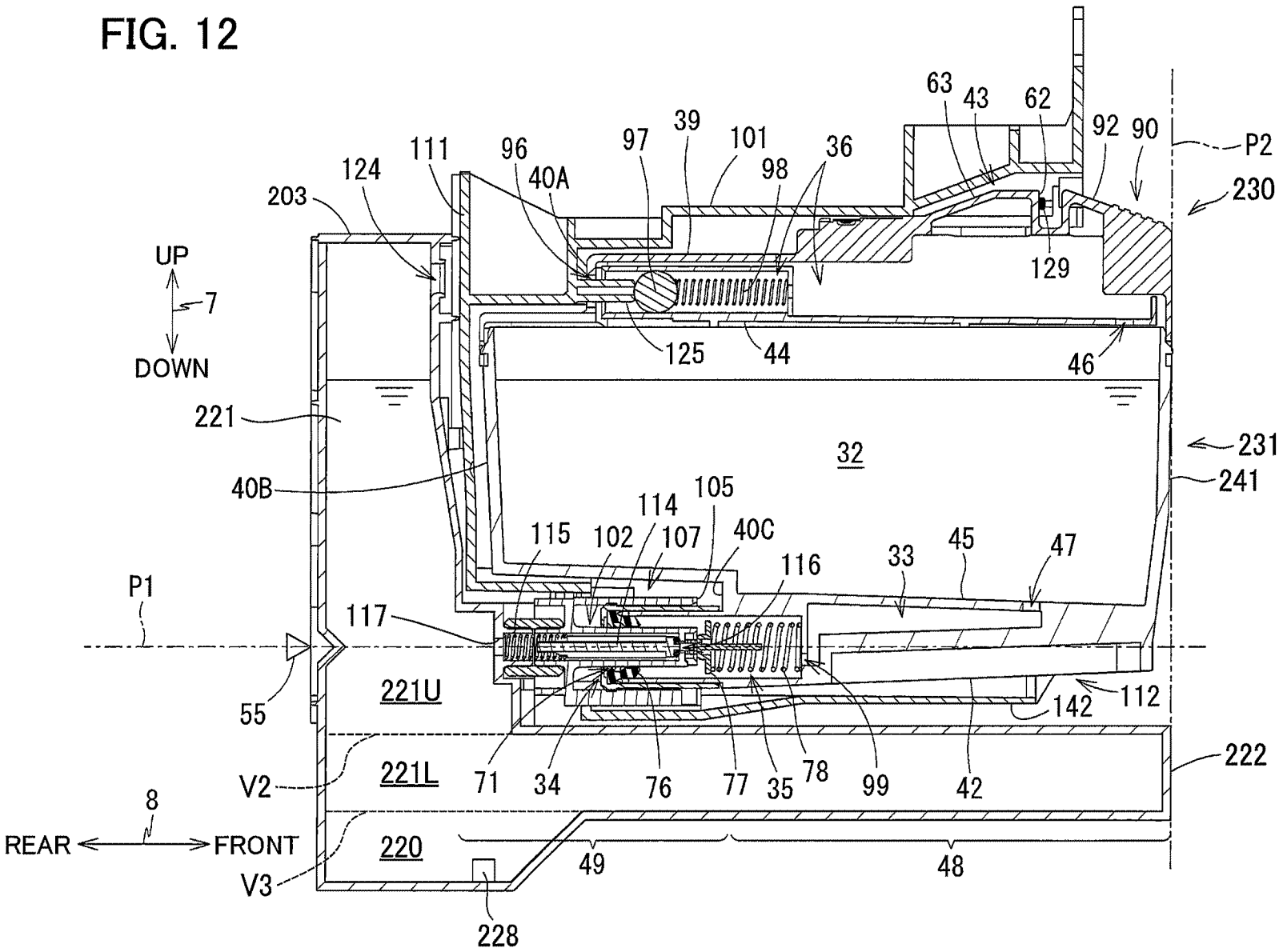
FIG. 12 is a vertical cross-sectional view illustrating the cartridge receiving portion and the ink cartridge attached thereto in the multifunction peripheral according to the second embodiment.

Further, the tank visual-recognition surface 222 is visible from the outside of the casing 214 through the window 284 even when the cover 287 is closed. Further, the level of the ink stored in the upper storage chamber 32 and the lower storage chamber 33 can also be visually recognized through the front wall 241 of the ink cartridge 230 through the window 284 even when the cover 287 is closed. Further, as illustrated in FIGS. 10B, and 12, in the attached state of the ink cartridges 230 to the cartridge receiving portion 210 of the multifunction peripheral 10A in the operable posture, the front wall 241 of each ink cartridge 230 is arranged above the tank visual-recognition surface 222 of the corresponding tank 203 and these are arrayed in the up-down direction 7. Hence, the user can easily recognize the level of ink stored in the upper storage chamber 32 and lower storage chamber 33 of each ink cartridge 230 as well as the level of ink stored in the storage chamber 221 of each tank 203.

Modifications to Second Embodiment

Figure 13:
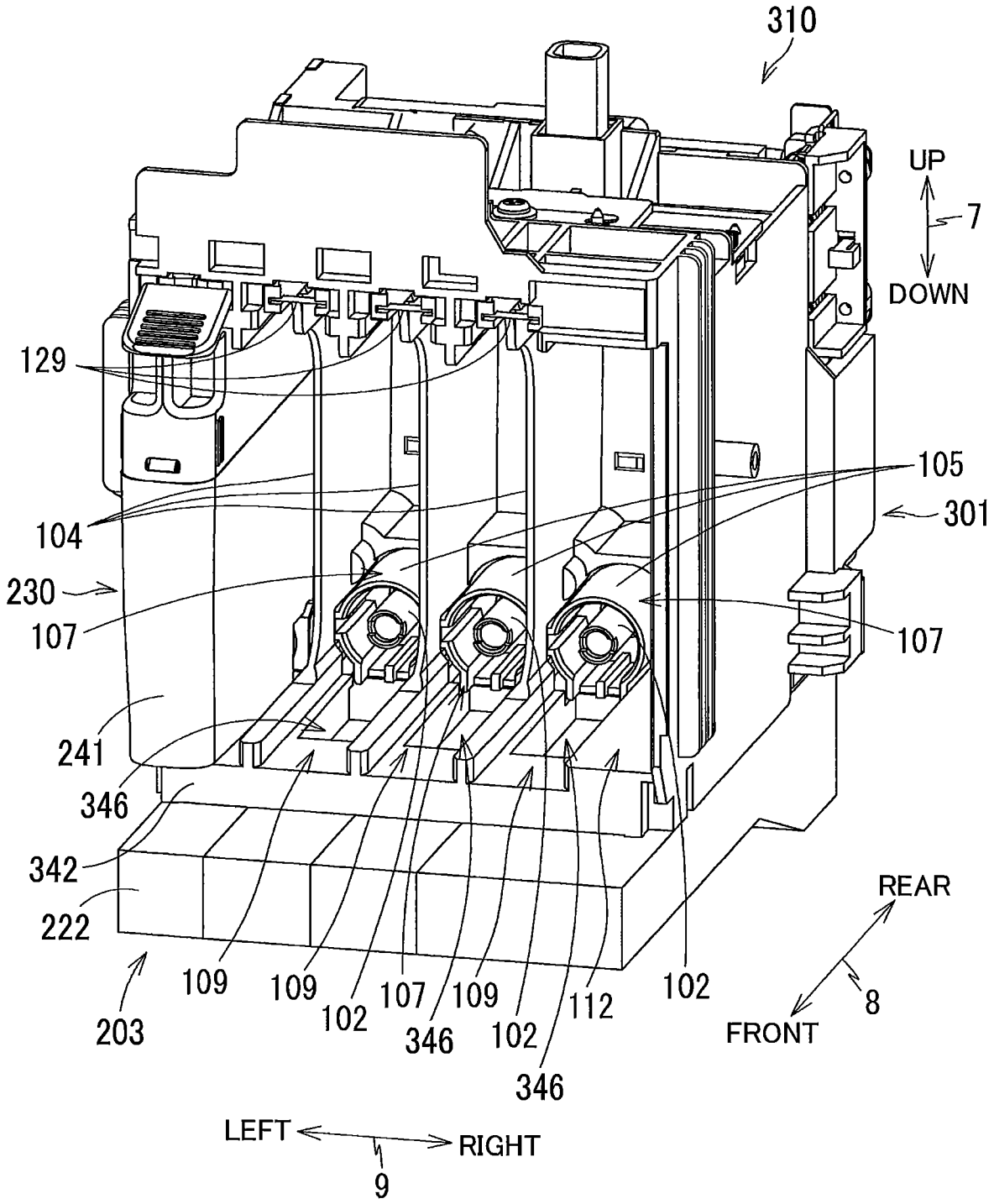
FIG. 13 is a perspective view of a cartridge receiving portion according to a first modification to the second embodiment.

FIG. 13 illustrates a cartridge receiving portion 310 according to a first modification to the second embodiment. The cartridge receiving portion 310 includes a cartridge case 301, the joints 107, and the tanks 203 of the second embodiment. The cartridge case 301 has a bottom wall 342 that is formed with four through-holes 346 one each in each guide groove 109. Each through-hole 346 extends through a thickness of the bottom wall 442 in the up-down direction 7. Thus, an upper wall of the lower region 221L of each tank 203 is visible through the corresponding through-hole 346. In this modification, the upper wall of the lower region 221L of each tank 203 may be light transmissive so that the upper wall of the lower region 221L functions as a tank visual-recognition surface. With this structure, the state of the ink stored in the lower region 221L of each tank 203 can be visually recognized through the corresponding through-hole 346 by removing the corresponding ink cartridge 30 from the cartridge receiving portion 310, even in a configuration where the front surface (tank-visual recognition surface 222) of the lower region 221L is invisible from the outside of the casing 214. In this case, the user can visually recognize each through-hole 346 of the cartridge case 301 through the window 284 of the cover 287 in the closed state, by detaching the corresponding ink cartridge 230 from the cartridge receiving portion 310.

Further, the configuration of the window 284 of the cover 287 is not limited to that of the above-described second embodiment. That is, the window 284 need not to allow both the front wall 241 of the ink cartridge 230 and the tank visual-recognition surface 222 of the tank 203 to be visible.

Figure 14:
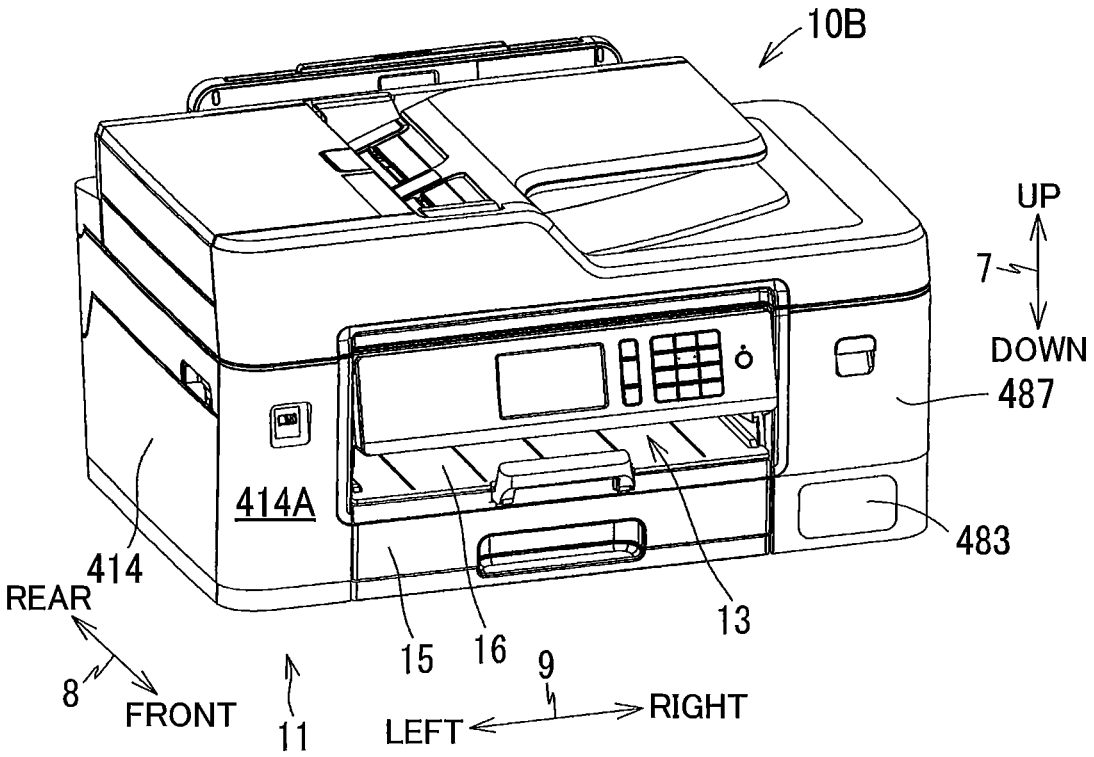
FIG. 14 is a perspective view of a multifunction peripheral according to a second modification to the second embodiment.

For example, FIG. 14 depicts a multifunction peripheral 10B according to a second modification to the second embodiment. The multifunction peripheral 10B includes a casing 414 provided with a cover 487. In this modification, the cover 487 is exclusively used for opening and closing the opening 112 of the cartridge case 101. That is, the cover 487 is positioned higher relative to the tank visual-recognition surfaces 222 of the tanks 203. A front surface 414A of the casing 414 is formed with a window 483 at a position below the cover 487. With this structure, the tank visual-recognition surfaces 222 of the tanks 203 are all visible from the outside through the window 483. In this case, the front wall 241 of each ink cartridge 230 may not necessarily be light transmissive.

In this modification, the window 483 is not necessarily be provided with a light transmissive member. For example, the window 483 may be a through-hole penetrating through a thickness of the front wall 414A of the casing 414 in the front-rear direction 8. In a case that the window 483 is a through-hole, a cover for covering the window 483 may also be provided at the casing 414.

Figure 15:
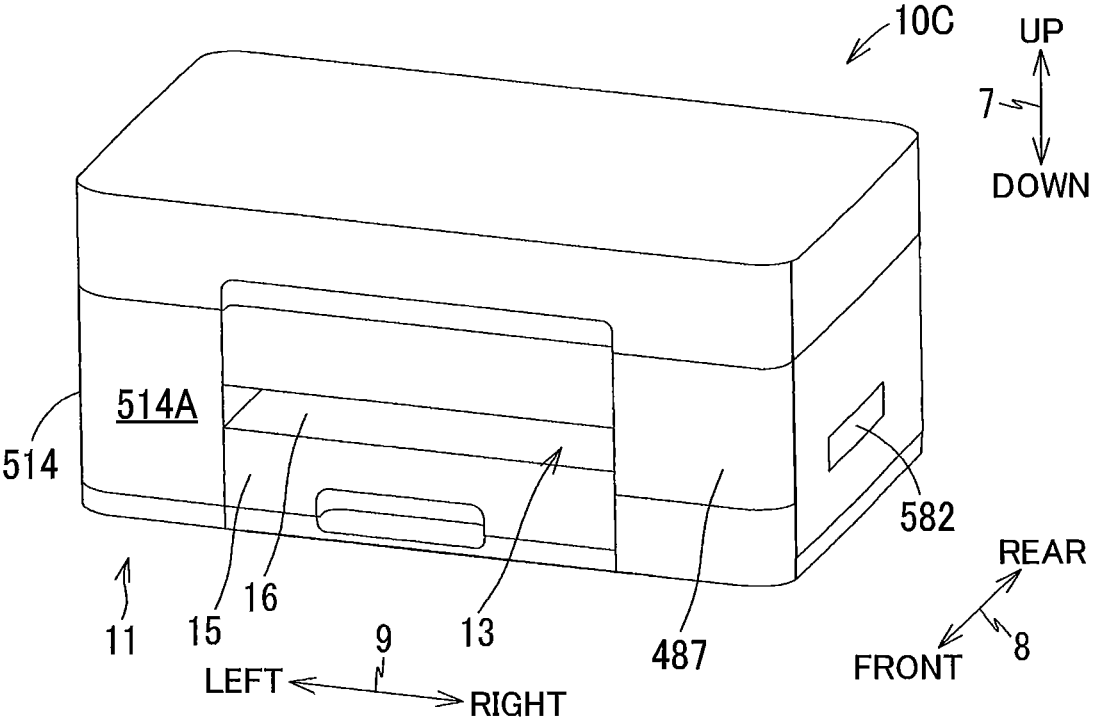
FIG. 15 is a perspective view of a multifunction peripheral according to a third modification to the second embodiment.

FIG. 15 depicts a multifunction peripheral 10C according to a third modification to the second embodiment. While the tank visual-recognition surface 222 of each tank 203 faces frontward in the second embodiment, the tank visual-recognition surface 222 need not face frontward. As an example, in the third modification, a tank-visual recognition surface (not depicted in FIG. 15) is provided at a side wall of each tank 203. Hence, in this modification, a through-hole 582 is formed in a side wall of a casing 514 of the multifunction peripheral 10C, rather than in a front surface 514A of the casing 514, so that the tank visual-recognition surface of each tank 203 can be exposed to the outside of the casing 514 through the through-hole 582.

Incidentally, the tank visual-recognition surface of the disclosure may not be limited to a surface that allows the user to visually recognize the level of the ink stored in each tank 203. For example, a liquid passage such as a tube may be provided to connect the lower region 221L to the lowermost region 220 of the tank 203, and the liquid passage may be visible from the outside of the casing 214. In this case, the liquid passage is filled with the ink as long as the ink is stored in the lower region 221L, whereas the liquid passage may be filled with air when no ink is available in the lower region 221L. Accordingly, the user can recognize existence or non-existence of the ink in the lower region 221L by observing the liquid passage from the outside of the casing 214 to see whether the liquid passage is filled with the ink or not

Other Variations

According to the above-described embodiments, the ink cartridge 30, 230 is attached to and detached from the cartridge receiving portion 110, 210 in the front-rear direction 8 (from front side of the cartridge receiving portion 110, 210). However, the ink cartridge 30, 230 may not necessarily be attached to and detached from the cartridge receiving portion 110, 210 in the front-rear direction 8. For example, the ink cartridge 30, 230 may be attached to and detached from the cartridge receiving portion 110, 210 in the up-down direction 7 (from above, for example).

Remarks

The multifunction peripherals 10, 10A, 10B, 10C are an example of a liquid ejection device. The ink cartridge 30,

230 is an example of a cartridge. The upper storage chamber 32 and lower storage chamber 33 are an example of a first storage chamber. The air communication opening 96 is an example of a first air communication port. The ink supply portion 34 is an example of a supply portion. The base portion 48 is an example of a base portion. The protruding portion 49 is an example of a protruding portion. The through-hole 99 is an example of a communication opening. The cartridge receiving portion 110, 210 is an example of a cartridge receiving portion. The tanks 103, 103', 203 are an example of a tank. The joint 107 is an example of a joint. The storage chamber 121, 121' and 221 are an example of a second storage chamber. The upper region 121U is an example of an upper region. The lower regions 121L, 121L', 221L are an example of a lower region. The lowermost region 220 is an example of a lowermost region. The outlet ports 128, 228 are an example of an outlet port. The air communication port 124 is an example of a second air communication port. The recording head 21 is an example of a head. The cartridge cases 101, 301 are an example of a cartridge case. The opening 112 is an example of an opening of the cartridge case. The tank visual-recognition surface 222 is an example of a tank visual-recognition surface. The front wall 241 of the ink cartridge 230 is an example of a cartridge visual-recognition surface. The covers 287, 487 are an example of a cover. The windows 284, 483 and 582 are an example of a window. The through-hole 346 is an example of a through-hole.

What is claimed is:

1. A liquid ejection device comprising:

a cartridge comprising:

a first storage chamber configured to store therein a liquid;

a first air communication port allowing the first storage chamber to communicate with an atmosphere; and a supply portion configured to supply the liquid stored in the first storage chamber;

a cartridge receiving portion comprising:

a joint to which the supply portion is connectable;

a second storage chamber configured to store therein the liquid supplied, by water head difference, from the first storage chamber through the supply portion connected to the joint;

an outlet port positioned below the joint, the liquid stored in the second storage chamber is configured to be discharged through the outlet port; and a second air communication port allowing the second storage chamber to communicate with the atmosphere; and a head configured to eject the liquid flowing thereinto from the second storage chamber through the outlet port, wherein the second storage chamber has an upper region and a lower region positioned below the upper region defined in an operational posture of the liquid ejection device, the joint being connected to the upper region; and wherein the lower region has a portion positioned below a lowermost surface of the cartridge in a vertical direction and extending along the lowermost surface of the cartridge in a state where the supply portion of the cartridge is connected to the joint in the operational posture of the liquid ejection device, the portion of the lower region extending away from the upper region in a protruding direction crossing the vertical direction farther than the upper region.

2. The liquid ejection device according to claim 1, wherein the outlet port is connected to the lower region.

3. The liquid ejection device according to claim 1, wherein the portion of the lower region is aligned with the lowermost surface of the cartridge in the vertical direction in the state where the supply portion is connected to the joint in the operational posture of the liquid ejection device.

4. The liquid ejection device according to claim 1, wherein the cartridge is in an attached posture in a state where the supply portion of the cartridge is connected to the joint in the operational posture of the liquid ejection device;

wherein the cartridge comprises a base portion and a protruding portion defined based on the attached posture, the base portion having the lowermost surface, and the protruding portion protruding in a direction opposite to the protruding direction from an upper portion of the base portion;

wherein the first storage chamber spans over the base portion and the protruding portion; and wherein the supply portion is provided at the base portion.

5. The liquid ejection device according to claim 1, wherein the lower region including the portion has a horizontal cross-sectional area greater than a horizontal cross-sectional area of the upper region.

6. The liquid ejection device according to claim 1, wherein the supply portion has a communication opening that is open to the first storage chamber; and wherein the outlet port is connected to the lower region, the outlet port being positioned farther away from the upper region than the communication opening is from the upper region in the protruding direction in the state where the supply portion is connected to the joint in the operational posture of the liquid ejection device.

7. The liquid ejection device according to claim 1, wherein the joint is connected to the supply portion upon movement of the cartridge relative to the cartridge receiving portion in an attachment direction crossing the vertical direction; and wherein the joint is disconnected from the supply portion upon movement of the cartridge relative to the cartridge receiving portion in a detachment direction opposite the attachment direction.

8. The liquid ejection device according to claim 7, wherein the second storage chamber cartridge has an end positioned most upstream in the attachment direction, the end having a first surface constituting the portion of the lower region; and wherein the cartridge has a second surface constituting a most upstream end of the cartridge in the attachment direction, the first surface and the second surface being at the same position as each other in the attachment direction.

9. The liquid ejection device according to claim 7, wherein the second storage chamber cartridge has an end positioned most upstream in the attachment direction, the end having a first surface constituting the portion of the lower region; and wherein the cartridge has a second surface constituting a most upstream end thereof in the attachment direction, the first surface being positioned upstream relative to the second surface in the attachment direction.

10. The liquid ejection device according to claim 1, wherein the cartridge receiving portion further comprises a tank defining the second storage chamber therein, the tank including:

the outlet port;

the second air communication port; and an inlet port through which the liquid supplied from the first storage chamber through the supply portion connected to the joint is introduced into the second storage chamber; and wherein the tank has a tank visual-recognition surface through which the liquid stored in the second storage chamber is visible.

11. The liquid ejection device according to claim 10, wherein the tank-visual recognition surface is positioned at the lower region.

12. The liquid ejection device according to claim 11, wherein the second storage chamber further comprises a lowermost region positioned below the lower region; and wherein the outlet port is positioned at the lowermost region.

13. The liquid ejection device according to claim 10, wherein the tank visual-recognition surface allows a level of the liquid stored in the second storage chamber to be visible.

14. The liquid ejection device according to claim 10, further comprising:

a casing; and a cartridge case provided in the casing and having an opening, the cartridge being attachable to and detachable from the cartridge case horizontally through the opening.

15. The liquid ejection device according to claim 14, wherein the casing has a surface formed with a casing opening; and wherein the tank visual-recognition surface of the tank and the opening of the cartridge case are visible through the casing opening.

16. The liquid ejection device according to claim 15, wherein the cartridge includes a cartridge visual-recognition surface through which a level of the liquid stored in the first storage chamber is visible; and wherein the cartridge visual-recognition surface is exposed to the outside of the casing through the opening of the cartridge case in a state where the cartridge is attached to the cartridge case.

17. The liquid ejection device according to claim 14, wherein the casing has a window through which the tank visual-recognition surface of the tank is visible from the outside of the casing.

18. The liquid ejection device according to claim 17, wherein the casing includes a cover configured to open and close the opening of the cartridge case, the window being provided at the cover.

19. The liquid ejection device according to claim 17, wherein the casing includes a cover configured to open and close the opening of the cartridge case, the window being positioned below the cover.

20. The liquid ejection device according to claim 14, wherein the cartridge case has a bottom wall having a through-hole extending through a thickness of the bottom wall; and wherein the tank visual-recognition surface is visible through the through-hole in a state where the cartridge is detached from the cartridge case.

21. The liquid ejection device according to claim 20, wherein the casing includes a cover configured to open and close the opening of the cartridge case, the cover having a window; and wherein the through-hole of the cartridge case is visible from the outside through the window in a state where the cartridge is detached from the cartridge case.

* * * * *